US009695581B2

(12) United States Patent
Shinohara et al.

(10) Patent No.: US 9,695,581 B2
(45) Date of Patent: Jul. 4, 2017

(54) FLUSH OPERATING APPARATUS AND TOILET APPARATUS INCLUDING SAME

(71) Applicant: TOTO LTD., Fukuoka (JP)

(72) Inventors: Koki Shinohara, Kitakyushu (JP); Hideki Tanimoto, Kitakyushu (JP); Yukinori Kubozono, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 14/638,530

(22) Filed: Mar. 4, 2015

(65) Prior Publication Data

US 2015/0267387 A1 Sep. 24, 2015

(30) Foreign Application Priority Data

Mar. 19, 2014 (JP) ..... 2014-056330

(51) Int. Cl.
*E03D 5/10* (2006.01)
*E03D 1/34* (2006.01)

(52) U.S. Cl.
CPC *E03D 1/34* (2013.01); *E03D 5/10* (2013.01)

(58) Field of Classification Search
CPC ..... E03D 11/306; E03D 11/308; E03D 11/34; E03D 5/10; E03D 5/105; E03D 5/02
USPC ... 4/398, 399, 401, 405, 406, 313, 411, 412, 4/413, 414
See application file for complete search history.

(56) References Cited

U.S. PATENT DOCUMENTS 1,605,028 A * 11/1926 Hinkle ..... E03D 5/092 4/414
2,412,738 A * 12/1946 Martin ..... E03D 5/094 4/412
4,392,260 A * 7/1983 Bensen ..... E03D 1/142 4/249
5,003,643 A * 4/1991 Chung ..... E03D 5/10 4/304
5,901,384 A * 5/1999 Sim ..... E03D 5/105 4/302
6,618,864 B2 * 9/2003 Veal ..... E03D 5/105 4/313

(Continued)

FOREIGN PATENT DOCUMENTS

CN 2641156 Y 9/2004
TW GB 2260998 A * 5/1993 ..... E03D 5/10

OTHER PUBLICATIONS

Machine Translation for CN2641156.*

*Primary Examiner* — Erin Deery
(74) *Attorney, Agent, or Firm* — Studebaker & Brackett PC

(57) ABSTRACT

A flush operating apparatus includes: a flush valve for opening and closing a discharge port on a storage tank; a manual operating unit, provided on the flush water tank and capable of manually operating the motion of the flush valve; a powered operating unit capable of operating the motion of the flush valve with power; and a control device for receiving a toilet flush start signal transmitted from either an instruction device by which a user instructs a toilet flush operation, or from a body sensor for sensing a user and activating a power drive motor; wherein the powered operating unit is separately installed from the manual operating unit, and is installed so as to be removable from the flush water tank in accordance with flush water tank apparatus or toilet main unit usage conditions.

10 Claims, 15 Drawing Sheets

(56) References Cited

U.S. PATENT DOCUMENTS

| | | | | |
|---|---|---|---|---|
| 8,201,283 | B2 * | 6/2012 | Ciski | E03D 5/094 4/325 |
| 8,393,018 | B2 * | 3/2013 | Huang | E03D 5/092 4/324 |
| 9,340,962 | B2 * | 5/2016 | Tanimoto | E03D 5/094 |
| 9,447,569 | B2 * | 9/2016 | Shinohara | E03D 3/12 |
| 2008/0072369 | A1 * | 3/2008 | Funari | E03D 5/105 4/313 |
| 2009/0307833 | A1 * | 12/2009 | Ciski | E03D 5/094 4/417 |

* cited by examiner

FLUSH OPERATING APPARATUS AND TOILET APPARATUS INCLUDING SAME

BACKGROUND OF THE INVENTION

Field of the Invention

The present invention pertains to a flush operating apparatus and toilet apparatus including same, and in particular to a flush operating apparatus for operating the flushing of flush water from a flush water tank into a toilet, and to a toilet apparatus including this flush operating apparatus.

Description of Related Art

Conventionally known flush operating apparatuses for operating the flushing of flush water into a toilet from a flush water tank in which toilet flush water is stored include, as set forth for example in Patent Document 1 (China Registered Utility Model 2641156), those having an operating lever, rotationally operated by a user using only manual action, a drive apparatus linked to this operating lever, furnished with a drive shaft rotated by a user's rotary operation, and a wire member linking the flush valve for opening and closing the flush water tank discharge port with the drive apparatus to raise the flush valve by rotating the drive shaft on the drive apparatus.

In a conventional flush operating apparatus such as that set forth in Patent Document 1, when a user starts an operation to discharge flush water from the flush water storage tank into the toilet, the user first clasps the operating lever and rotates it, and when the drive shaft of the drive apparatus is manually rotated and driven together with the operating lever, a wire member moves, the flush valve is raised by the wire member, and the discharge port on the flush water tank is released.

BRIEF SUMMARY OF THE INVENTION

Technical Problem

In recent years, however, in the pursuit of greater ease of use for flush operating apparatuses, the issue has become one of how to improve usability, without limitation to a user's ability to directly manually operate the toilet, including as well the automation of the flush operation, such as by electrically powering the operation itself of the flush operating apparatus.

Moreover, in recent years, as the diversity of flush water tank and toilet specifications has grown, the constituent parts of flush water tanks and toilets, etc. have been standardized as much as possible in order to minimize manufacturing costs, but there is a question as to how easily designs can be implemented to change the specifications of flush water tanks and toilets, etc. according to usage conditions of those flush water tanks and toilets, such as the way in which the flush water tanks and toilets are installed and used.

In addition, in recent years as specifications for flush water tanks and toilets have become more diverse, the issue has arisen of the need to improve usability so that an appropriate selection can be made between manual and automatic operation, both with respect the simplicity of the means for changing a specification, and to the method of operating a flush toilet apparatus.

Therefore the present invention was undertaken to resolve the above-described technical requirements, and has the object of providing a flush operating apparatus which, with respect to the method of flush operation for operating the flushing of flush water from a flush water tank to a toilet, is capable of easily making an appropriate selection between manual and powered methods according to flush water tank and toilet usage conditions, thereby providing a flush operating apparatus with improved ease of use.

Solution to Problem

In order to achieve this object, the present invention is a flush operating apparatus, being a flush operating apparatus for discharging flush water from a flush water tank into a toilet, having: a flush valve for opening and closing a discharge port on a flush water tank for storing flush water to flush a toilet; a manual operating unit, provided on the flush water tank and capable of manually operating the motion of the flush valve; a powered operating unit, being a powered operating unit capable of operating the motion of the flush valve with power, furnished with a rotary drive shaft for rotationally driving from the outside using electrical power; a power drive transfer portion, linked to the rotary drive shaft of this powered drive portion, for transferring the rotational drive force of the powered drive portion; and a powered operation linking member, linked at one end with the powered drive transfer portion and at the other end with the flush valve; and a control portion for receiving a toilet flush start signal transmitted from either an instruction portion by which a user instructs a toilet flush operation, or from a body sensing portion that senses a user, and activating the powered drive portion; wherein the powered operating unit is separately installed from the manual operating unit, and is installed so as to be removable from the flush water tank in accordance with flush water tank or toilet usage conditions.

In the invention thus constituted, the powered operating unit capable of power-operating a flush valve to open and close a discharge port on a flush water tank is installed as a separate item from the manual operating unit, and is installed so as to be removable from the flush water tank in accordance with flush water tank or toilet usage conditions (e.g., flush water tank or toilet specifications or installation conditions), therefore when performing a toilet flushing operation with a powered operation unit attached, operation of the flush valve can be controlled by a user's manual operation of a manual operating unit, and operation of the flush valve can be controlled by the powered operation of a powered operating unit, so that an appropriate selection can be made as needed of the method for operating the flush valve. Also, when a user operates the action of the flush valve by a powered operation using the powered operating unit, the control portion receives a toilet flush start signal transmitted from either an instruction portion by which a user instructs a toilet flushing operation, or by a body sensing portion that senses a user, thus enabling the automatic activation of the powered drive portion of the powered operating unit. Therefore the rotary drive force of the powered drive portion is transferred as operating force from the powered drive transfer portion to the flush valve through a powered operation linking member, so that the action of the flush valve can be automated. As a result, when compared to toilet flushed using only a manual operating unit, the flush valve can be operated efficiently, and ease of use improved. On the other hand, when the powered operating unit is unnecessary, the structure of the flush water tank or toilet can be simplified by removing only the powered unit, and a change can be easily effected to a specification allowing for toilet flushing operation by a manual operating unit on its own, thus improving ease of use. Also, due to the ease of later attachment of a powered unit to existing flush water tanks or toilets not furnished with a powered operating unit and including only a manual operating unit, the flush water tank or toilet specification and flush operating method can be easily changed, thereby improving usability.

In the present invention, the manual operating unit preferably includes a manual rotary shaft, a manual operating portion for manual rotary operation of this manual rotary shaft, a manual rotary force transfer portion that transfers the rotary force of this manual rotary shaft, and a manual operation linking member, linked at one end with the manual rotary force transfer portion, and at the other end with the flush valve; the flush valve includes a powered operation linking portion to which the other end of the powered operation linking member is removably linked, and a manual operation linking portion to which the other end of the manual operation linking member is removably linked; when operating the powered operating unit, the other end of the powered operating linking member is linked with the powered operating linking portion, and the link between the other end of the manual operation linking member and the manual operation linking portion of the flush valve is released, therefore when operating the manual operating unit, the other end of the manual operating linking member and the flush valve manual operation linking portion are linked, while the link between the other end of the powered operation linking member and the flush valve powered operation linking portion is released.

In the invention thus constituted, when operating a powered operating unit, the other end of the powered operation linking member is linked to the flush valve powered operation linking portion, while the link between the other end of the manual operation linking member and the flush valve manual operation link portion is released; when operating the manual operating unit, the other end of the manual operation linking member is linked to the flush valve manual operation linking portion, while the link between the other end of the powered operation linking member and the flush valve powered operation linking portion is released, therefore a state wherein the other end of the powered operation linking member and the other end of the manual operation linking member are simultaneously respectively linked to the flush valve powered operation linking portion and the manual operation linking portion during a powered operation by the powered operating unit or a manual operation by the manual operating unit can be prevented. When operating the flush valve by power or manually using the powered operating unit or manual operating unit, mutual interference between the powered operation linking member and the manual operation linking member can be prevented, and the simultaneous transfer of excessive operating force to the flush valve from both the powered operation linking member and the manual operation linking member can be prevented. Therefore since either the powered operation linking member or the manual operation linking member can operate the flush valve by itself, usability can be improved.

In the present invention an interference prevention portion that prevents interference between the powered operation linking member and the manual operation linking member is preferably provided between the powered operation linking portion and the manual operation linking portion of the flush valve.

In the invention thus constituted, because an interference prevention portion that prevents a mutual interference between the powered operation linking member and the manual operation linking member is provided between the powered operation linking portion and the manual operation linking portion of the flush valve, mutual interference between the powered operation linking member and the manual operation linking member can be reliably prevented when operating the flush valve, irrespective of whether powered operation by the powered operating unit or manual operation by the manual operating unit, and flush valve operability can be thereby improved.

In the present invention the flush valve preferably includes a valve body portion which opens and closes by the up and down movement of the discharge port formed on the bottom portion of the flush water tank; the powered operation linking portion and manual operation linking portion are respectively arrayed in parallel on the top end portion extending upward from this valve body portion; the interference prevention portion is a partition wall formed to partition the powered operation linking portion from the manual operation linking portion.

In the invention thus constituted, the flush valve includes a valve body portion for opening and closing by raising and lowering a discharge port formed in the bottom portion of a flush water tank; a powered operation linking portion and a manual operation linking portion are respectively arrayed in parallel at the top end portion extending from this valve body portion, and since a partitioning wall for partitioning between the powered operation linking portion and the manual operation linking portion is formed as an interference prevention portion that prevents the interference between the powered operation linking member and the manual operation linking member, mutual interference between the powered operation linking member and the manual operation linking member when a flush valve is power or manually operated by the powered operating unit or the manual operating unit can be effectively prevented using a simple structure, and an efficient connection can be made to the powered operation linking portion and the manual operation linking portion of the flush valve.

In the present invention, a first slot into which the powered operation linking member is detachably inserted and attached is preferably formed as the interference prevention portion on the powered operation linking portion of the flush valve; a second slot into which the manual operation linking member is insertably attached is formed as the interference prevention portion on the manual operation linking portion of the flush valve; the other end of the powered operation linking member is formed to be larger than the size of the first slot, and includes a first raised portion able to latch the first slot when operating the powered operating unit; and the other end of the manual operation linking member is formed to be larger than the size of the second slot, and includes a first raised portion able to latch the second slot when operating the manual operating unit.

In the invention thus constituted, when the powered operating unit is operated, the first raised portion of the other end of the powered operation linking member and the first slot in the powered operation linking portion of the flush valve are locked and linked, while the link between the second raised portion on the other end of the manual operation linking member and the second slot of the manual operation linking portion of the flush valve is released. On the other hand, when the manual operating unit is operated, the link between the second raised portion on the other end of the manual operation linking member and the second slot of the manual operation linking portion of the flush valve is locked and linked when operating the manual operating unit, while the link between the first slot on the other end of the powered operation linking member and the first slot of the powered operation linking portion of the flush valve is released. Therefore the condition can be prevented in which the respective first raised portion on the other end of the powered operation linking member and second raised portion on the other end of the manual operation linking member simultaneously latch and link, respectively, to the first slot of the flush valve powered operation linking portion and the second slot of the manual operation linking portion during powered operation by the powered operating unit or manual operation by the manual operating unit. Also, because the powered operation linking member and the manual operation linking member are respectively independently inserted into the first slot of the flush valve powered operation linking portion and the second slot of the manual operation linking portion as an interference prevention portion, mutual interference between the power operation linking member and manual operation linking member can be effectively prevented. Furthermore, excessive operating force can be prevented from being transferred to the flush valve by the first raised portion on the other end of the power operation linking member and the second rotating mechanism on the other end of the manual operation linking member, respectively. As a result, since either the powered operation linking member or the manual operation linking member can operate the flush valve by itself, usability can be improved. When the powered operating unit is not needed, the power operation linking member can be easily detached from the first slot in the powered operation linking portion of the flush valve with only the powered operating unit is removed, therefore specifications can easily be changed to allow a toilet flush operation using the manual operating unit alone, and usability can be improved.

In the present invention the powered operating unit power drive transfer portion preferably includes a power drive gear placed on the rotary drive shaft of the power drive portion, and a power receiving gear for meshing and engaging this power drive gear; the power drive gear and power receiving gear are designed so that the torque of the rotary drive shaft of the power drive portion is less than the torque of the manual rotary shaft.

In the invention thus constituted, because the power drive gear of the powered operating unit power drive transfer portion and the power receiving gear are designed so that the torque of the power drive portion rotary drive shaft is less than the torque of the manual rotary shaft, the drive force of the power drive portion rotary drive shaft can be set low, and the entire powered operating unit can be made compact.

In the invention thus constituted, the powered drive transfer portion of the powered operating unit preferably further includes a rotary member on which the power receiving gear is placed, and the power receiving gear is designed to have a larger torque than the power drive gear; the rotary member, linked to one end of the power operation linking member, is constituted so that the power operation linking member can be moved in the rotary direction of the rotary member by rotation together with the power receiving gear.

In the invention thus constituted, the power receiving gear placed on the rotary member of the powered drive transfer portion of the powered operating unit is designed to have a larger torque than the power drive gear, and can cause the power operation linking member to move together with the power receiving gear along the direction of rotation of the rotary member using the rotation by this rotary member, therefore even if the drive force of the rotary drive shaft on the powered operation linking portion is set low, the power receiving gear and rotary member can rotate at a higher torque than the power drive gear. Therefore the power operation linking member can be efficiently moved together with the rotation of the rotary member, and the entire powered operating unit can be made compact.

Next, the present invention is a toilet apparatus having: the flush operating apparatus, a toilet main unit including a bowl portion, and a flush water tank, being a flush water tank for storing flush water to flush the bowl portion of this toilet main unit, on the inside of which the flush valve of the flush operating apparatus is positioned.

In the invention thus constituted, when performing a toilet flushing operation with a flush operating apparatus powered operating unit attached, a toilet apparatus can be provided with which a user can control the action of the flush valve manually using the manual operating unit, and can control the operation of the flush valve with power using the powered operating unit, and an appropriate selection of the operating method for operating the flush valve can be made as needed. When a user controls the operation of the flush valve with power using the powered operating unit, the flush valve can be more efficiently actuated compared to when the toilet flushing operation is performed using the manual operating unit only, and a toilet apparatus with improved usability can be provided. On the other hand, when the powered operating unit is unnecessary based on usage conditions of the flush water tank or toilet (e.g., flush water tank or toilet specifications or installation conditions, etc.), the structure of the flush water tank or toilet main unit can be simplified by removing only the powered operating unit, and specifications can be easily changed so that the toilet flushing operation is possible with the flush operating apparatus manual operating unit on its own, therefore a toilet with improved usability can be provided. Furthermore, since a powered operating unit can be easily attached to an existing flush water tank including only a manual operating unit and not furnished with a powered operating unit, flush water tank or toilet specifications and flush operating methods can be easily changed, and a toilet apparatus with improved usability can be provided.

In the present invention the power drive portion and the powered drive transfer portion of the powered operating unit are preferably removably attached to the flush water tank in accordance with flush water tank or toilet usage conditions, and a hole or channel into which the powered operating unit power operation linking member can be inserted is formed between the interior and exterior of the flush water tank above the flush water stop level in the flush water tank.

Therefore the flush water tank or toilet specification and flush operating method can be easily changed in accordance with flush water tank or toilet usage conditions, and a toilet apparatus with improved usability can be provided. In a state wherein the power drive portion and the powered drive transfer portion of the powered operating unit of the flush operating apparatus are attached to the flush water tank, the power drive portion and the powered drive transfer portion of the powered operating unit are disposed outside the flush water tank, so flush water inside the flush water tank does not impinge thereon, and malfunctions can be prevented.

In the present invention the powered operating unit power drive portion and powered drive transfer portion are preferably attached to a housing portion placed on the side surface of the flush water tank, and a cover member is attached to the housing portion so as to cover the power drive portion and powered drive transfer portion from their outside.

In the present invention the flush operating apparatus powered operating unit is preferably removably attached on the interior of the flush water tank in accordance with flush water tank or toilet usage conditions.

In the invention thus constituted, the flush operating apparatus powered operating unit is removably attached on the interior of the flush water tank in accordance with flush water tank or toilet usage conditions, therefore the peripheral space on the outside of the flush water tank can be simplified, and a toilet with improved usability can be provided.

Using the flush operating apparatus of the present invention, with respect to the flush operation method for operating the discharge of flush water from a flush water tank to a toilet, a manual or powered system can be easily selected as appropriate, and usability improved.

DETAILED DESCRIPTION OF THE INVENTION

Below, referring to the attached figures, we explain a flush operating apparatus according to a first embodiment of the invention.

Figure 1:
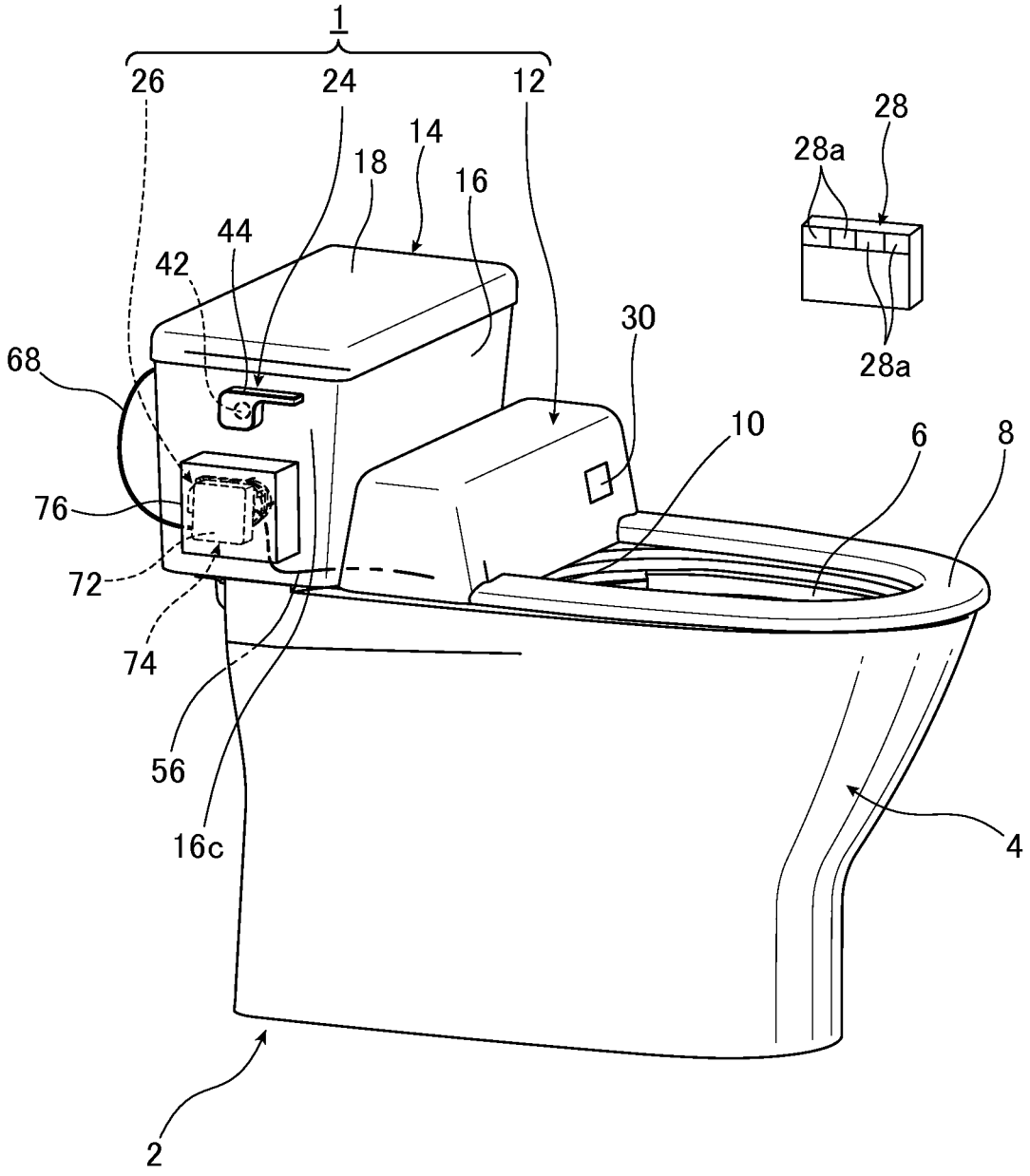
FIG. 1 is a summary perspective view showing a toilet apparatus to which a flush operating apparatus according to a first embodiment of the invention is applied.
Figure 2:
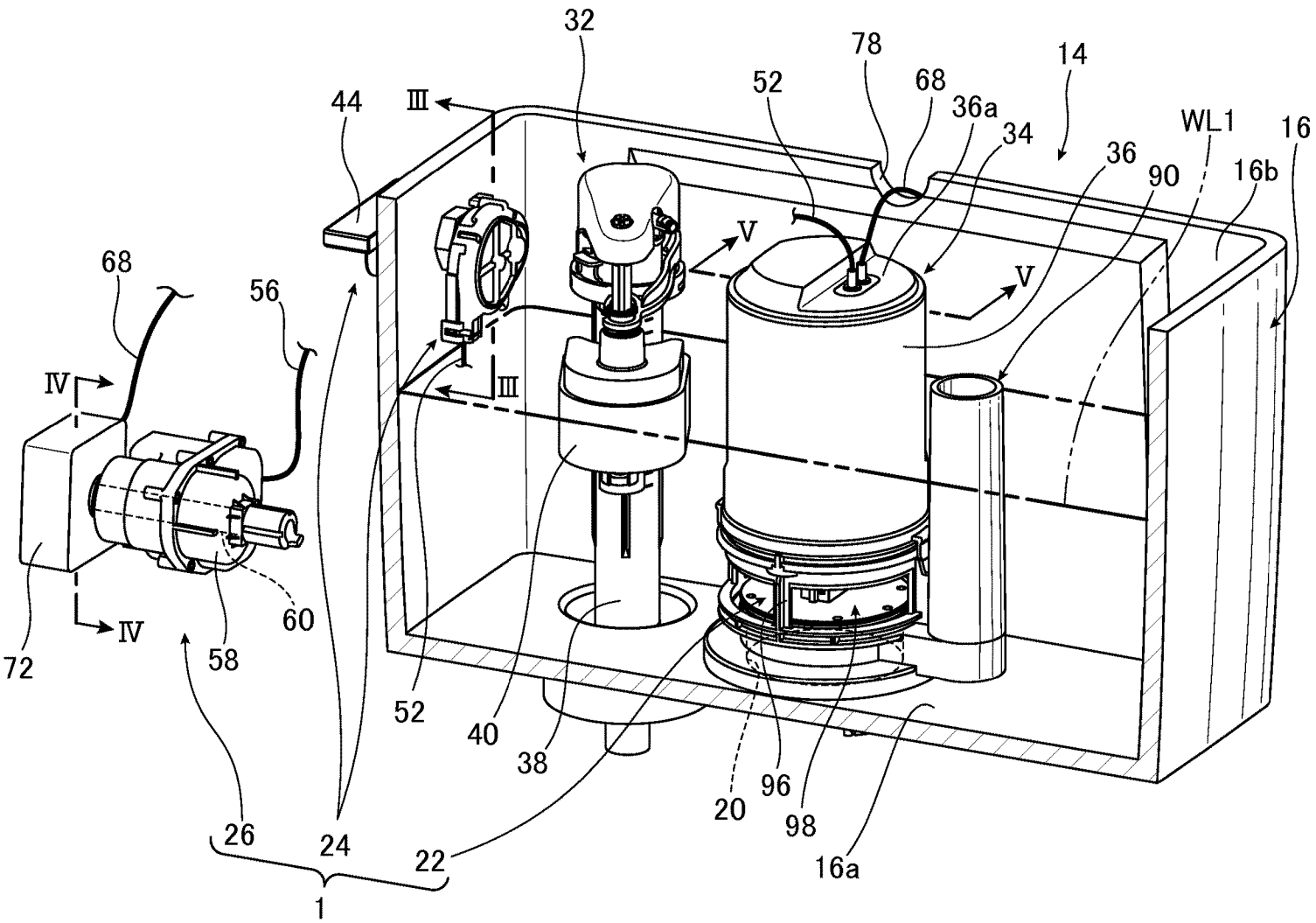
FIG. 2 is a perspective view seen from the front of and diagonally above the internal structure with the lid body removed in a toilet apparatus flush water tank apparatus to which a flush operating apparatus according to a first embodiment of the invention is applied.

First, referring to FIGS. 1 and 2, we explain the structure of a toilet apparatus to which a flush operating apparatus according to a first embodiment of the invention is applied.

FIG. 1 is a summary perspective view showing a toilet apparatus to which a flush operating apparatus according to a first embodiment of the invention is applied.

As shown in FIG. 1, a toilet apparatus 2, to which flush operating apparatus 1 according to a first embodiment of the invention is applied, includes a toilet main unit 4 formed of porcelain or resin; inside this toilet main unit 4, a bowl-shaped bowl portion 6 for receiving waste is formed. A discharge trap conduit (not shown) is connected to the bottom portion of bowl portion 6. The downstream end portion of this discharge trap conduit (not shown) is connected through a water discharge socket (not shown) to a discharge pipe (not shown) on the underfloor side of toilet main unit 4, or to a discharge port on the wall rear side at the back of toilet main unit 4; waste flushed inside bowl portion 6 of toilet main unit 4 is evacuated together with flush water from the discharge trap conduit (not shown) through the discharge socket (not shown) to an external discharge pipe (not shown) on the downstream side.

A toilet seat 8 is disposed on the top surface of toilet main unit 4; a control device 12 is placed at the back of this toilet seat 8 to control groin washing apparatus 10 for washing a user's groin with warm water after use, and for operating the motion of related electrical equipment such as the powered operating unit described in detail below. This control device 12 is connected to an external power supply in the periphery of toilet apparatus 2.

A flush water tank apparatus 14 for storing flush water used when flushing toilet main unit 4 and supplying same to toilet main unit 4 is placed on the top surface of the toilet main unit 4 at the back of control device 12. This flush water tank apparatus 14 includes a storage tank 16 in which flush water is stored, and a lid body 18, attached so as to cover the top of this storage tank 16.

Note that toilet main unit 4 of toilet apparatus 2, to which flush operating apparatus 1 of the embodiment is applied, may be applied to what is known as a wash-down type of toilet, in which flush water supplied from flush water tank apparatus 14 to toilet main unit 4 evacuates waste using the height drop in toilet main unit 4 bowl portion 6, or to what is known as a siphon type of toilet in which the siphon effect is utilized so that waste in the bowl portion 6 is suctioned in and evacuated all at once to the outside from the discharge trap conduit (not shown), or to various other types of flush toilets.

Next, FIG. 2 is perspective view seen from the front of and diagonally above the internal structure with the lid body removed in a toilet apparatus flush water tank apparatus to which a flush operating apparatus according to a first embodiment of the invention is applied.

As shown in FIGS. 1 and 2, the flush operating apparatus 1 of the present embodiment includes: a flush valve 22 for opening and closing the bottom portion 16*a* of storage tank 16 on flush water tank apparatus 14 by moving up and down a discharge port 20 which vertically penetrates bottom portion 16*a* in the storage tank 16 of flush water tank apparatus 14; a manual operating unit 24 formed on the side portion of storage tank 16, operable by a manual up down motion of the flush valve 22 placed on the side portion of storage tank 16; and a powered operating unit 26 capable of power operating the up-down motion of flush valve 22. This powered operating unit 26 is provided separately from manual operating unit 24, and is detachably placed relative to toilet main unit 4 as appropriate, in accordance with flush water tank apparatus 14 or toilet main unit 4 usage conditions, such as specifications including the flush method for flush water tank apparatus 14 or toilet main unit 4, or installation environment such as water supply pressure at the location of installation, or installation conditions including the placement environment, such as the layout within the toilet apparatus 2 installation space.

As shown in FIG. 1, an instruction device 28 including multiple operating buttons 28*a* for instructing a groin washing operation by groin washing apparatus 10 is attached to the wall surface on the side of toilet apparatus 2 toilet main unit 4.

Furthermore, a human sensor 30, being a human body sensing portion capable of sensing the presence of a user sitting on toilet seat 8, or a user standing in front of toilet main unit 4, is placed on control device 12. When a signal indicating a toilet flushing operation is transmitted to control device 12 due to the pushing by a user of a predetermined operating button 28*a* on instruction device 28, and/or when a signal sensing a user is transmitted by human sensor 30, control device 12 receives these signals and operates powered operating unit 26.

Note that in the present embodiment we discuss a configuration includes both a human sensor 30 and an instruction device 28, but it is also acceptable to omit either one of these and allow control device 12 to activate powered operating unit 26 based on the signal transmitted from only the other device.

Next, as shown in FIG. 2, a water supply apparatus 32 for supplying flush water inside storage tank 16, and a discharge apparatus 34 for opening discharge port 20 relative to flush water accumulated in storage tank 16, causing that water to flow out a conduit (not shown) in toilet main unit 4, are placed with flush water tank apparatus 14 storage tank 16. Also the flush valve 22 of the above-described flush operating apparatus 1 is placed so as to be movable up and down within cylindrical casing 36, which forms the exterior of discharge apparatus 34.

Water supply apparatus 32 includes a water supply pipe 38 connected to an external water supply source (not shown) and extending upward from the bottom portion of storage tank 16, a water supply valve (not shown), attached to the top end portion of this water supply pipe 38, for switching between spouting and stopping water supplied from water supply pipe 38 into storage tank 16, and a float 40 for switching between spouting and stopping of water by the water supply valve (not shown) by moving up or down in response to fluctuations in the water level inside storage tank 16. At the bottom end portion on the exterior periphery of water supply pipe 38, the spout port is released, and flush water passing through the supply valve (not shown) is spouted into storage tank 16 from the spout port (not shown).

In water supply apparatus 32, when flush water inside storage tank 16 is discharged to the toilet by discharge apparatus 34, the level of the flush water drops and float 40 falls; this causes the supply valve (not shown) to release, so that spouting of water from the spout port (not shown) starts, and spouting into storage tank 16 from a water supply source (not shown) outside flush water tank apparatus 14 is started.

Moreover, when spouting is continued and the water level inside storage tank 16 rises, float 40 rises, causing the supply valve (not shown) to close, so that spouting from the spout port (not shown) is stopped. This results in the flush water level inside storage tank 16 being maintained at the predetermined water level when full.

Figure 3:
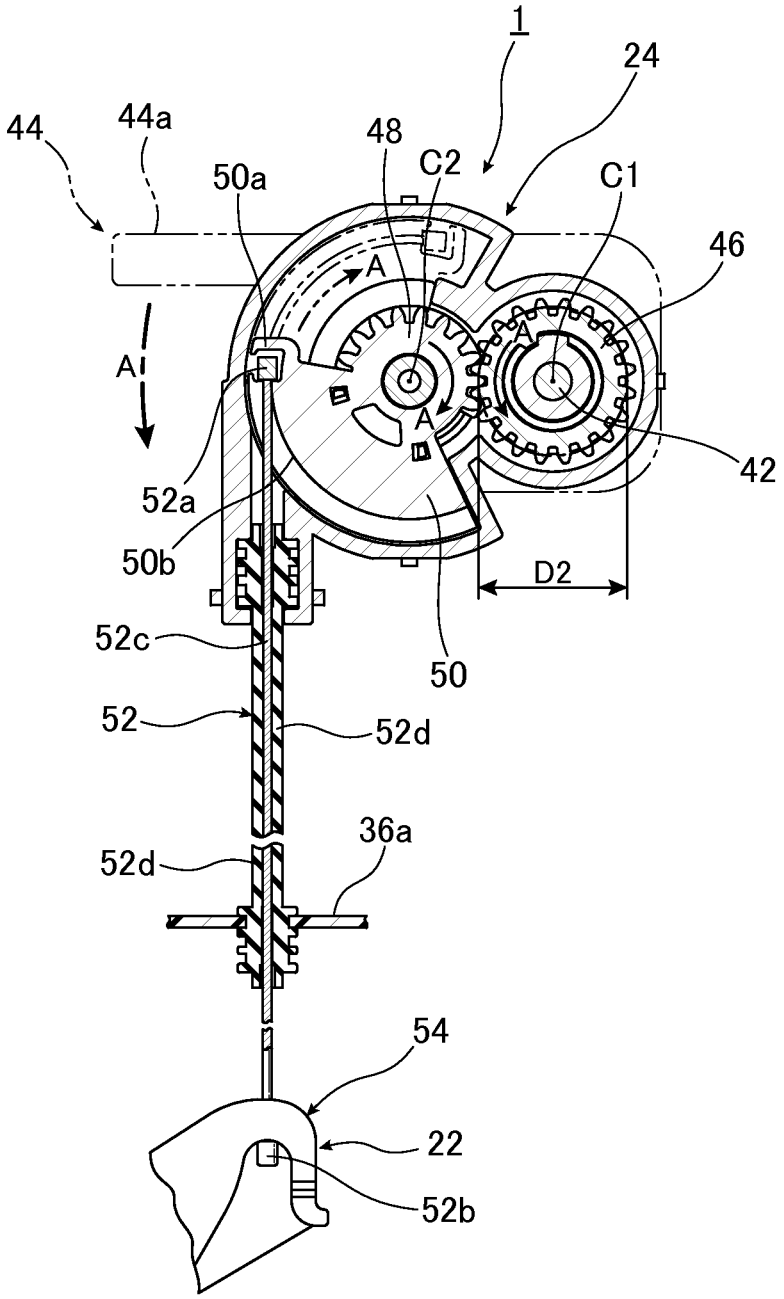
FIG. 3 is a schematic cross section seen along line III-III in FIG. 2 in a flush operating apparatus manual operating unit according to a first embodiment of the invention.

Next, referring to FIGS. 1 through 3, we explain in concrete terms the manual operating unit 24 of a flush operating apparatus 1 according to a first embodiment of the invention.

FIG. 3 is a schematic cross section seen along line III-III in FIG. 2 in a flush operating apparatus manual operating unit according to a first embodiment of the invention.

As shown in FIGS. 1 through 3, flush operating apparatus 1 manual operating unit 24 includes a manual rotary shaft 42 capable for rotating about a rotation center axis line C1, and a manual operating lever 44 linked to this manual rotary shaft 42, clasped by the user when manually rotating manual rotary shaft 42.

As a manual rotary force transfer portion that transfers the rotary force of manual rotary shaft 42, manual operating unit 24 includes: a manual drive gear 46 affixed and attached on the same rotation center axis line C1 relative to manual rotary shaft 42, a manual drive receiving gear 48 for meshing with and engaging this manual drive gear 46, capable of rotating about rotation center axis line C2, and a pulley 50, being a rotating member formed integrally with this manual drive receiving gear 48 in the form of a minor circular sector seen in plan view and able to rotate about rotation center axis line C2.

In addition, manual operating unit 24 includes a manual operation linking member 52. One end portion 52*a* of this manual operation linking member 52 is affixed and linked to linking portion 50*a*, which is provided on a part of the outer perimeter of pulley 50; the other end portion 52*b* of manual operation linking member 52 is linked so as to be linkable and attachable to manual operation linking portion 54, provided on the top end portion of flush valve 22, described in detail below.

More specifically, manual operation linking member 52 includes a metal manual operation wire member 52*c* with plasticity and relatively high elasticity, and an outside hose member 52*d* with plasticity and durability for covering the periphery of this manual operation wire member 52*c*.

One end portion of outside hose member 52*d* is affixed and attached to a part of case 53 which houses manual drive gear 46, manual drive receiving gear 48, and pulley 50; the other end portion of outside hose member 52*d* is affixed and attached to the top end portion 36*a* of discharge apparatus 34 casing 36; pulling up one end portion 52*a* of manual operation wire member 52*c* causes manual operation wire member 52*c* to become slidable in the longitudinal direction relative to outside hose member 52*d*.

Note that in the present embodiment we discuss an example using manual operation wire member 52*c* as an example of a manual operation linking member 52 linked to the manual operation linking portion 54 of flush valve 22, but a member such as a resin or metal beads or the like may also be applied in lieu of the wire member.

For example, when releasing flush valve 22 by a manual operation using manual operating unit 24 in flush operating apparatus 1 starting from a state in which flush valve 22 closes off discharge port 20 (the standby state), as shown by arrow A for the manual operation direction in FIG. 3, the user, by rotating manual operating lever 44 about rotation center axis line C1 so as to pull it downward, causes manual rotary shaft 42 and manual drive gear 46 to rotate about rotation center axis line C1, so that manual drive receiving gear 48 and pulley 50 rotate about rotation center axis line C2. Thus the manual operation linking member 52 manual operation wire member 52*c* moves as it is spooled onto pulley 50 outer circumference 50*b* together with the rotation of pulley 50, and is pulled up by a predetermined length, so that flush valve 22 is placed into a closed state.

Also, a return spring (not shown) is disposed within manual operating unit 24 for rotating manual operating lever 44 so that it returns to its original standby state position when a user removes his/her hand from manual operating lever 44 with manual operation linking member 52 pulled up and flush valve 22 in an opened state.

Next, referring to FIGS. 1 and 2 through 4, we explain in concrete terms the powered operating unit 26 of a flush operating apparatus 1 according to a first embodiment of the invention.

Figure 4:
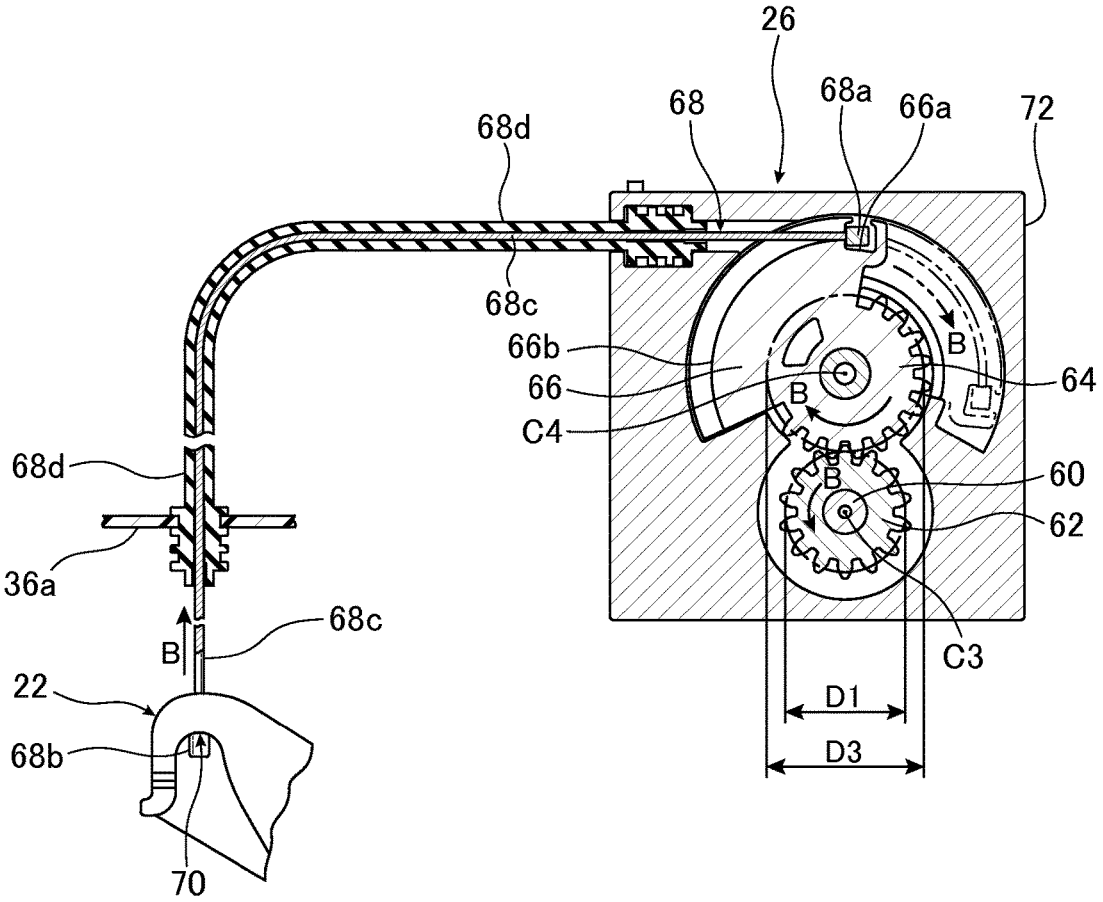
FIG. 4 is a schematic cross section seen along line IV-IV in FIG. 2 in a flush operating apparatus power operating unit according to a first embodiment of the invention.

FIG. 4 is a schematic cross section seen along line IV-IV in FIG. 2 in a flush operating apparatus power operating unit according to a first embodiment of the invention.

As shown in FIGS. 1 and 2 through 4, powered operating unit 26 includes a power drive motor 58 connected to electrical wire 56 extending from control device 12, to which power supplied to control device 12 from an external power supply in the periphery of toilet apparatus 2 is supplied through electrical wire 56, and power drive motor 58 includes a power rotary drive shaft 60 for rotary driving using electrical power.

As a power drive transfer portion that transfers the rotary drive power of power drive motor 58 power rotary drive shaft 60, powered operating unit 26 includes: a powered drive gear 62 affixed and attached on the same rotation center axis line C3 as power rotary drive shaft 60; a power receiving gear 64 for meshing and engaging this powered drive gear 62, capable of rotating about rotation center axis line C4; and pulley 66, being a rotating member formed integrally with this power receiving gear 64 in the form of a minor circular sector seen in plan view, able to rotate about rotation center axis line C4 together with power receiving gear 64.

In addition, powered operating unit 26 includes a powered operation linking member 68. One end portion 68*a* of this powered operation linking member 68 is affixed and linked to a linking portion 68*a* disposed on a part of the outside periphery of pulley 66; the other end portion 68*b* of powered operation linking member 68 is detachably linked to a powered operation linking portion 70 disposed on the top end portion of flush valve 22, described in detail below.

More specifically, powered operation linking member 68, like manual operation linking member 52, includes a metal powered operation wire member 68*c* with plasticity and relatively high elasticity, and an outside hose member 68*d* with plasticity and durability for covering the periphery of this powered operation wire member 68*c*.

One end portion of outside hose member 68*d* is affixed to part of box-shaped casing 72 enclosing powered drive gear 62, power receiving gear 64, and pulley 66, and the other end portion of outside hose member 68*d* is affixed to the top end portion 36*a* of casing 36 in discharge apparatus 34; by pulling up on the one end portion 68*a* of powered operation wire member 68*c*, powered operation wire member 68*c* becomes capable of sliding in the longitudinal direction relative to outside hose member 68*d*.

Note that in the present embodiment we discuss an example using powered operation wire member 68*c* as an example of a powered operation linking member 68 linked to the powered operation linking portion 70 of flush valve 22, but a member such as resin or metal beads or the like may also be applied in lieu of the wire member.

Moreover, the powered operating unit 26 casing 72 containing powered drive gear 62, power receiving gear 64, pulley 66, and one end portion 68*a* of powered operation linking member 68, plus power drive motor 58, are attached to the housing portion 74 (see FIG. 1) disposed on one of the side surfaces 16*c* of storage tank 16 (the left side surface when seen from the front of storage tank 16), so as to be appropriately removable depending on the usage conditions of flush water tank apparatus 14, toilet main unit 4, etc. A cover member 76 is also removably attached to housing portion 74 so as to cover casing 72 and power drive motor 58 from the outside.

The above items result in the disposition of powered operating unit 26 power drive motor 58, powered drive gear 62, and power receiving gear 64 of flush operating apparatus 1 on the outside of flush water tank apparatus 14 storage tank 16, so that no flush water inside storage tank 16 impinges thereon, and malfunctions can be prevented. Also, since cover member 76 prevents dust from adhering to power drive motor 58, powered drive gear 62, power receiving gear 64, and pulley 66, malfunctions can be prevented.

Note that in the present embodiment, with respect to the housing portion 74 and cover member 76 to which powered operating unit 26 casing 72 containing powered drive gear 62, power receiving gear 64, pulley 66, and one end portion 68*a* of powered operation linking member 68, and power drive motor 58, are removably attached, we explain a configuration in which these are disposed on one side surface 16*c* of storage tank 16, but without limitation to such a configuration, a configuration is also acceptable in which a housing portion and cover member are disposed on either the other side surface of storage tank 16 (the right side surface seen from the front of storage tank 16) or on the front surface of storage tank 16, as configurations in which the housing portion and cover member is disposed on the top surface of storage tank 16 lid body 18.

Next, as shown in FIGS. 3 and 4, powered operating unit 26 powered drive gear 62 and power receiving gear 64 are designed so that the reference circle diameter D1 of powered drive gear 62 has a smaller dimension than the reference circle diameter D2 of manual drive gear 46 (D1<D2), hence the maximum torque T1 of power drive motor 58 power rotary drive shaft 60 can be designed to be smaller than the maximum torque T2 of manual operating unit 24 manual rotary shaft 42. This allows for a design with a low drive force (maximum torque T1) of power drive motor 58 power rotary drive shaft 60, and enables a reduction in size of the entire powered operating unit 26 casing 72.

Also, power receiving gear 64 reference circle diameter D3 is designed to have a larger dimension than powered drive gear 62 reference circle diameter D1, and power receiving gear 64 maximum torque T3 is designed to be larger than powered drive gear 62 maximum torque T1. Therefore even if power drive motor 58 power rotary drive shaft 60 maximum torque T1 is designed to be small, power receiving gear 64 and pulley 66 can turn at a larger torque than power rotary drive shaft 60 and powered drive gear 62, therefore powered operation linking member 68 can be efficiently moved along the outer circumference portion 66*b* of pulley 66, and the entire powered operating unit 26 casing 72 can be reduced in size.

For example, when opening flush valve 22 by a powered operation using flush operating apparatus 1 powered operating unit 26 starting from a state in which flush valve 22 is holding discharge port 20 closed (a standby state), if a user either instructs a toilet flushing operation by pushing a predetermined operating button 28*a* on instruction device 28, or human sensor 30 senses a user, these signals are transmitted to control device 12 and powered operating unit 26 power drive motor 58 is activated by a command from control device 12. Power rotary drive shaft 60 then rotates about rotation center axis line C3 a predetermined number of revolutions or to a predetermined rotary angle in the direction of rotation shown by arrow B in FIG. 4, and power receiving gear 64 and pulley 66 rotate about rotation center axis line C4. The powered operation linking member 68 thus moves as it is spooled onto the outer circumference portion 66*b* of pulley 66 with the rotation of power rotary drive shaft 60, whereby it is pulled up by a predetermined length and flush valve 22 is placed in an opened state.

Also, as shown in FIG. 2, a notched channel 78 is formed at approximately the left-right center of the top end portion of rear wall portion 16*b* forming flush water tank apparatus 14 storage tank 16, so as to penetrate in the front to back direction with an approximately U-shaped cross section. This notched channel 78 is positioned above the water stop level WL1 in storage tank 16, and allows for the insertion of powered operating unit 26 powered operation linking member 68 between the exterior and interior of storage tank 16.

Note that we explain a configuration in which notched channel 78, into which powered operation linking member 68 can be inserted, is disposed on the top end portion of storage tank 16 rear wall portion 16*b*, but without such limitation, it can also be disposed on the top end portion of the front wall portion or side wall portion of storage tank 16, so long as the position of notched channel 78 is above water stop level WL1 inside storage tank 16. Also, an insertion hole into which powered operation linking member 68 can be inserted can also be disposed at a position above water stop level WL1 on the side wall surface of storage tank 16.

Next, referring to FIG. 1, FIG. 2, and FIGS. 5-14, we discuss specifically the discharge apparatus 34 into which flush valve 22 of flush operating apparatus 1 according to a first embodiment of the invention is built, as well as the flush valve 22 of flush operating apparatus 1 according to a first embodiment of the invention, and manual operation linking portion 54 and powered operation linking portion 70 of this flush valve 22.

Figure 5:
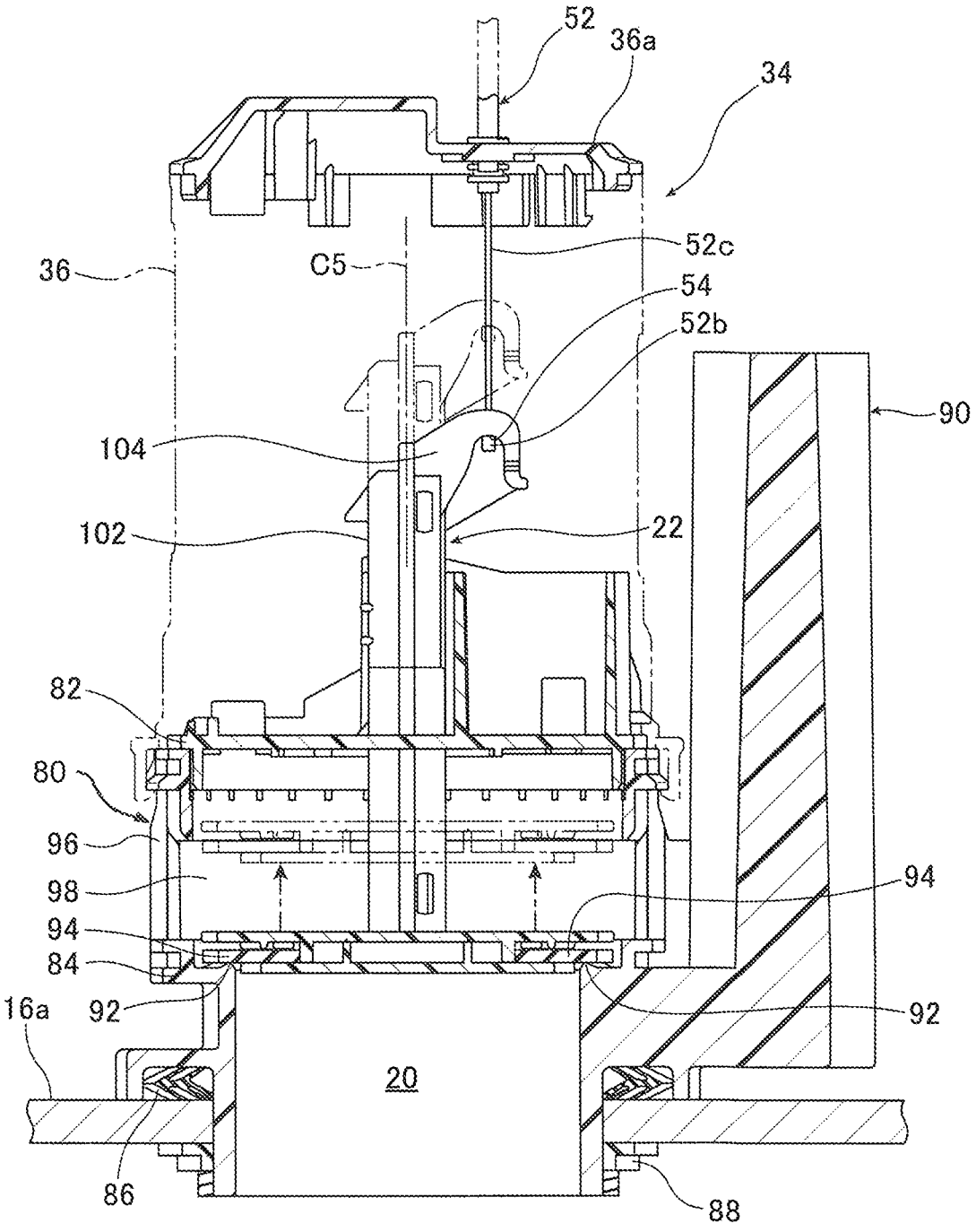
FIG. 5 is a schematic cross section seen along line V-V of the part of the flush valve shown in FIG. 2, showing the state in which the flush valve is closed in a flush operating apparatus according to a first embodiment of the invention.

FIG. 5 is a schematic cross section seen along line V-V of the part of the flush valve shown in FIG. 2, showing the state in which the flush valve is closed in a flush operating apparatus according to a first embodiment of the invention.

Here FIG. 5 shows a simplified form of structures and mechanisms other than the discharge apparatus 34 casing 36 and flush valve 22 on the interior thereof. Also, in FIG. 5 the position of the flush valve with when it has risen to its highest and is in an open state during power operation of the flush operating apparatus is shown by a dot and dash line.

First, as shown in FIG. 1 and FIGS. 2 through 5, discharge apparatus 34, into which flush valve 22 of flush operating apparatus 1 of the present embodiment is built, includes a discharge port unit 80 forming a discharge port 20, and is attached to the bottom portion 16*a* within storage tank 16, communicating with the toilet main unit 4 conduit (not shown), and a discharge holding member 82, attached to the top end of this discharge port unit 80 and holding flush valve 22 so that it can move up and down.

Discharge port unit 80 of discharge apparatus 34 is attached at a predetermined position on the bottom portion 16*a* of storage tank 16, and includes a discharge port-forming member 84 forming discharge port 20. The bottom end portion of this discharge port-forming member 84 penetrates storage tank 16 bottom portion 16*a*, is tightened by tightening member 88 through seal member 86, and discharge port-forming member 84 is affixed to the bottom portion 16*a* of storage tank 16.

Also, an overflow pipe 90 formed to extend in the vertical direction is disposed on a portion of the outside circumference of discharge port-forming member 84, and the downstream end portion positioned at the bottom of overflow pipe 90 communicates with the discharge port 20 on the interior of discharge port-forming member 84.

Furthermore, discharge port-forming member 84 includes a toilet seat 92, formed along the top edge of discharge port 20 and over its entire circumference, projecting upward; discharge port 20 is closed off when this toilet seat 92 contacts flush valve 22 valve body 94.

Discharge port-forming member 84 includes multiple support column portions 96 extending upward from positions spaced a predetermined distance apart facing out from toilet seat 92; these support column portions 96 are disposed at predetermined intervals along the circumferential direction, and multiple connecting ports 98 are formed between adjacent support column portions 96 to cause flush water on the outside of discharge apparatus 34 to flow into discharge port 20.

Figure 6:
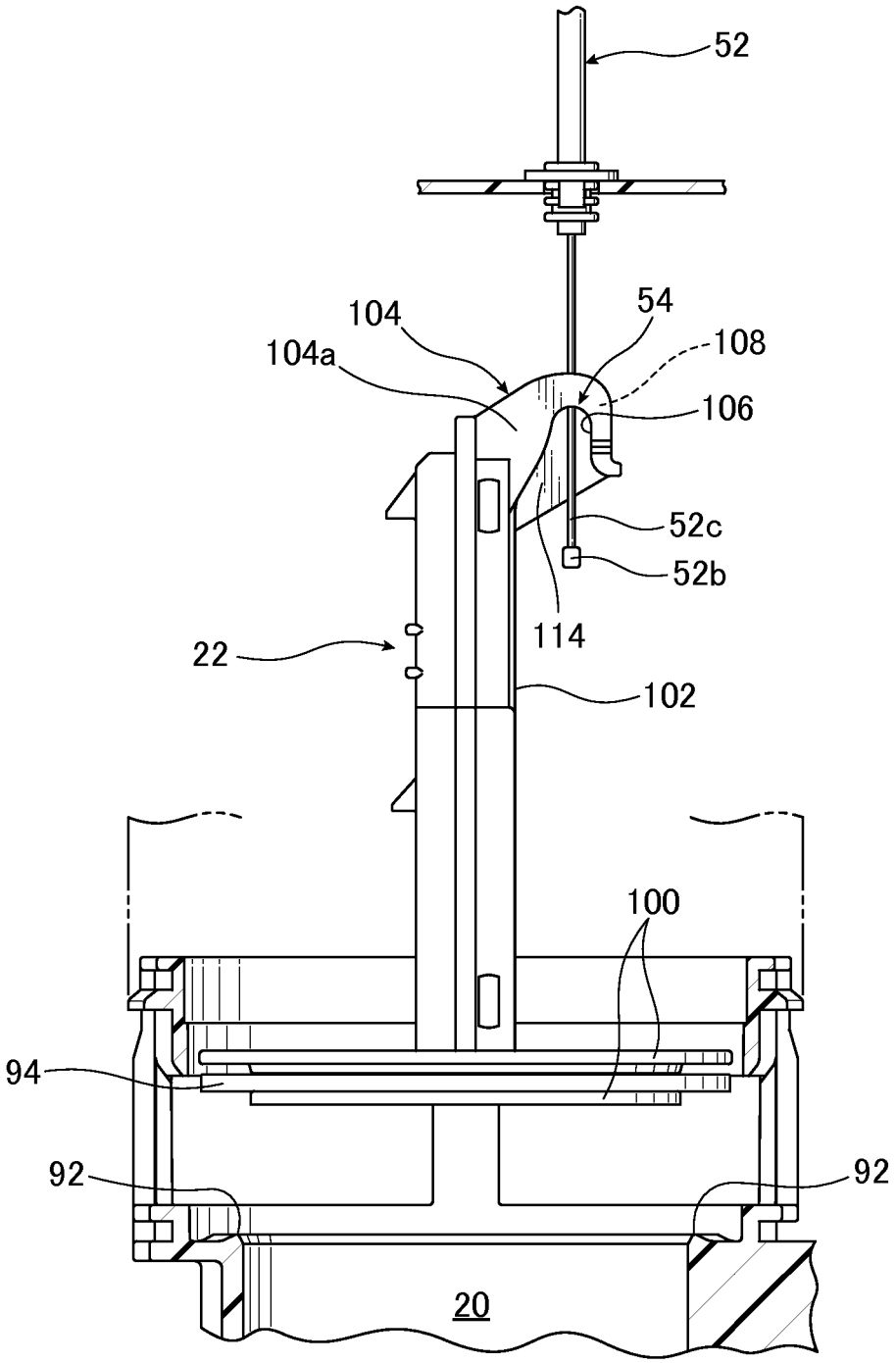
FIG. 6 is a front elevation of a flush operating apparatus flush valve and powered operating unit powered operating wire member and manual operating wire member according to a first embodiment of the invention, showing the flush valve opened by a powered operation using the powered operating unit.
Figure 7:
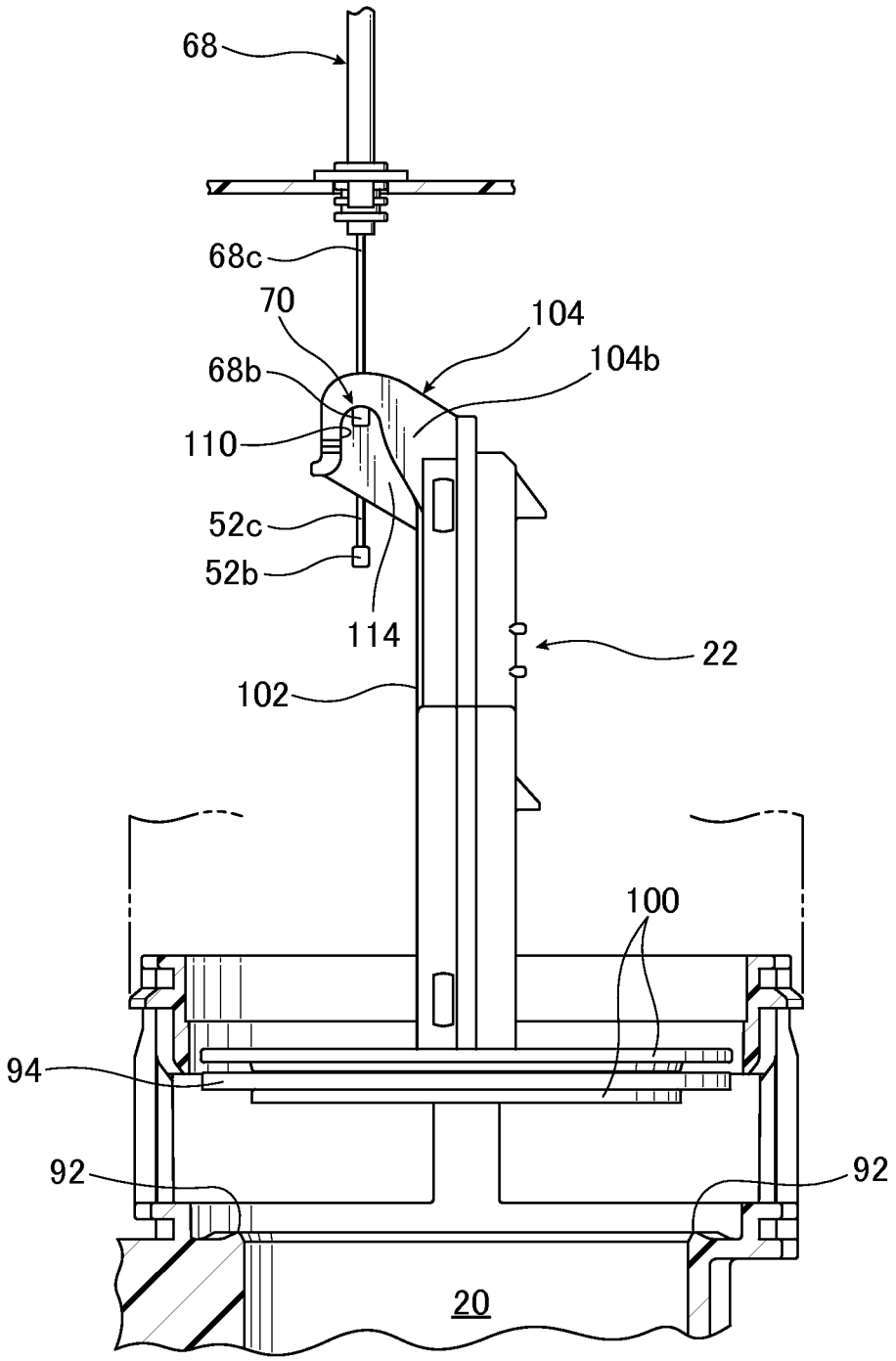
FIG. 7 is a rear elevation of a flush operating apparatus flush valve and powered operating unit powered operating wire member and manual operating wire member according to a first embodiment of the invention, showing the flush valve opened by a powered operation using the powered operating unit.

Next, FIG. 6 is a front elevation of a flush operating apparatus flush valve and powered operating unit powered operating wire member and manual operating wire member according to a first embodiment of the invention, showing the flush valve opened by a powered operation using the powered operating unit. Also, FIG. 7 is a rear elevation of a flush operating apparatus flush valve and powered operating unit powered operating wire member and manual operating wire member according to a first embodiment of the invention, showing the flush valve opened by a powered operation using the powered operating unit. In addition, FIG. 8 is a side elevation (the right side elevation of FIG. 6) of a flush operating apparatus flush valve and powered operating unit powered operating wire member and manual operating wire member according to a first embodiment of the invention, showing the flush valve opened by a powered operation using the powered operating unit.

Figure 8:
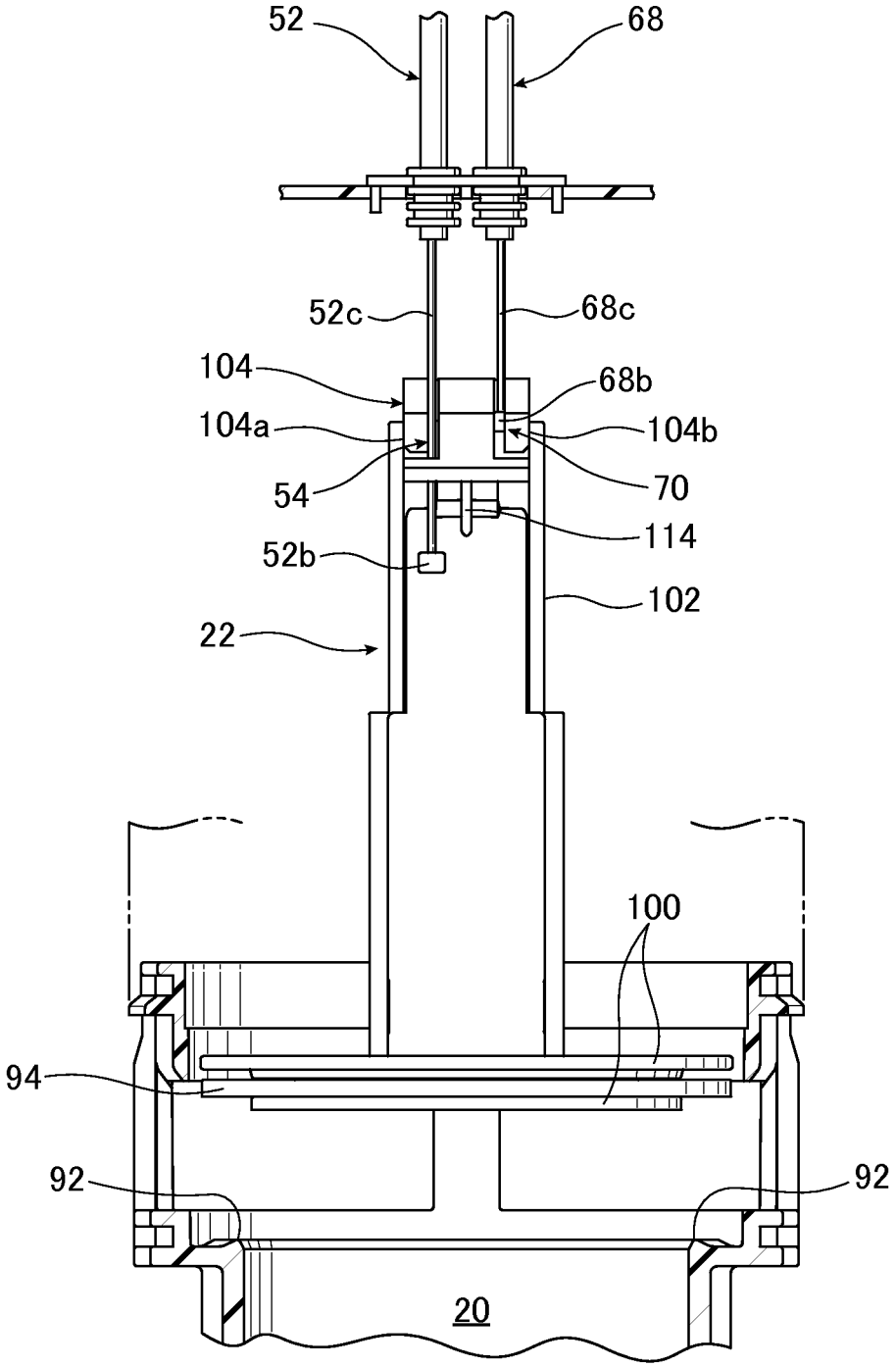
FIG. 8 is a side elevation (the right side elevation of FIG. 6) of a flush operating apparatus flush valve and powered operating unit powered operating wire member and manual operating wire member according to a first embodiment of the invention, showing the flush valve opened by a powered operation using the powered operating unit.
Figure 9:
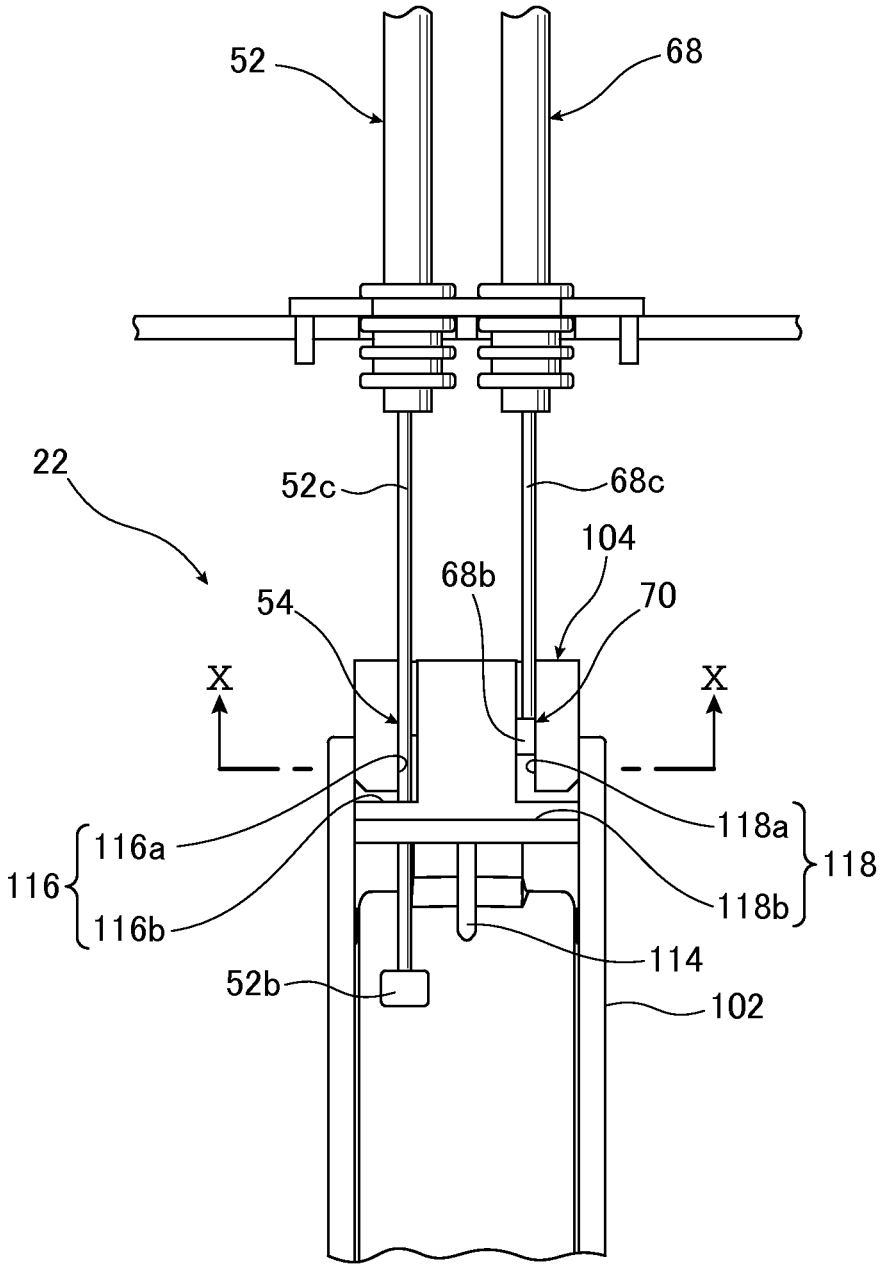
FIG. 9 is a partial expanded view of the part of the flush valve powered operation linking portion and manual operation linking portion on which the end portions of the powered control wire member and the manual operation wire member in FIG. 8 are respectively linked.
Figure 10:
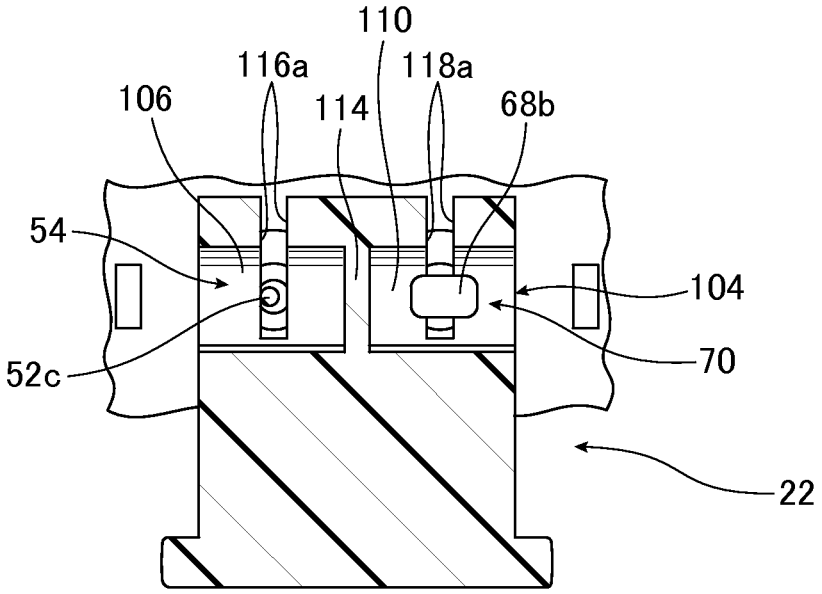
FIG. 10 is a cross section seen along line X-X in FIG. 9.

And FIG. 9 is a partial expanded view of the part of the flush valve powered operation linking portion and manual operation linking portion on which the end portions of the powered control wire member and the manual operation wire member in FIG. 8 are respectively linked; FIG. 10 is a cross section seen along line X-X in FIG. 9.

Figure 11:
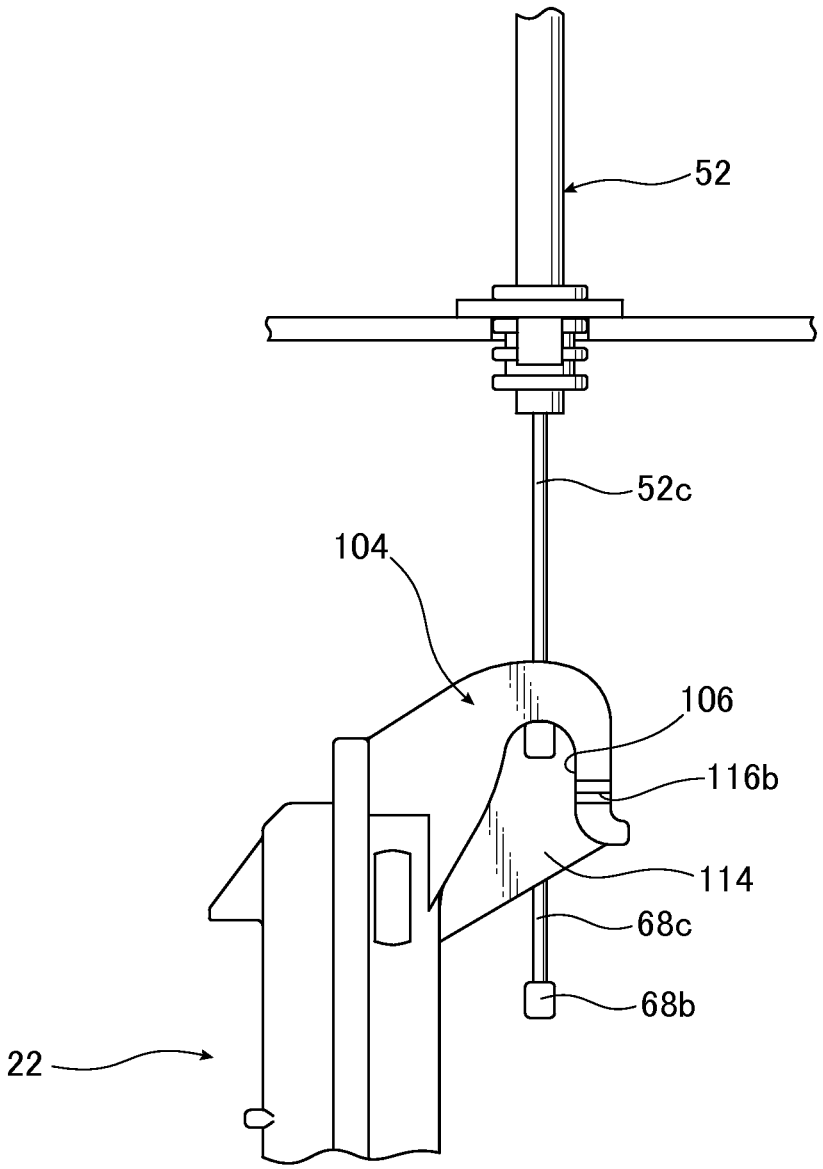
FIG. 11 is a partial expanded diagram of the flush valve powered operation linking portion whereby the flush valve of a flush operating apparatus according to a first embodiment of the invention is opened by a manual operation using the manual operating unit.
Figure 12:
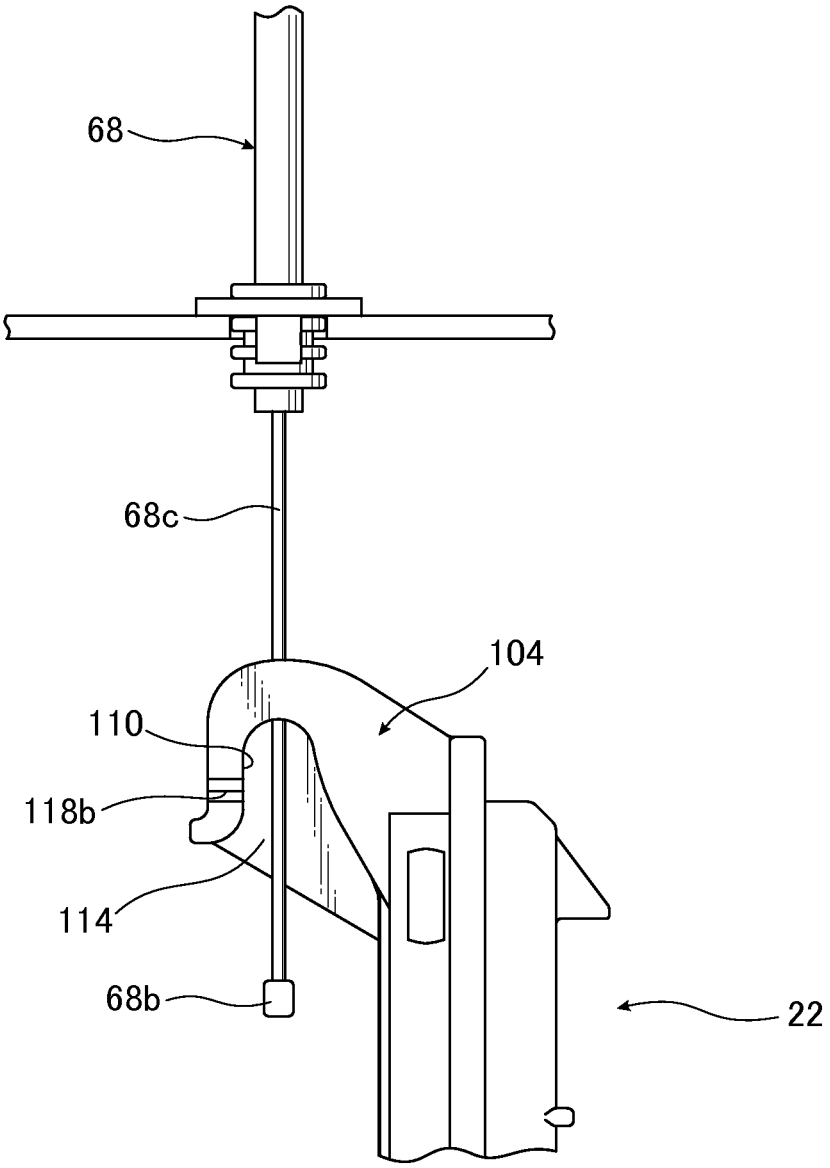
FIG. 12 is a partial expanded diagram of the flush valve manual operation linking portion whereby the flush valve of a flush operating apparatus according to a first embodiment of the invention is opened by a manual operation using the manual operating unit.

Furthermore, FIG. 11 is a partial expanded diagram of the flush valve powered operation linking portion whereby the flush valve of a flush operating apparatus according to a first embodiment of the invention is opened by a manual operation using the manual operating unit. FIG. 12 is a partial expanded diagram of the flush valve manual operation linking portion whereby the flush valve of a flush operating apparatus according to a first embodiment of the invention is opened by a manual operation using the manual operating unit.

Figure 13:
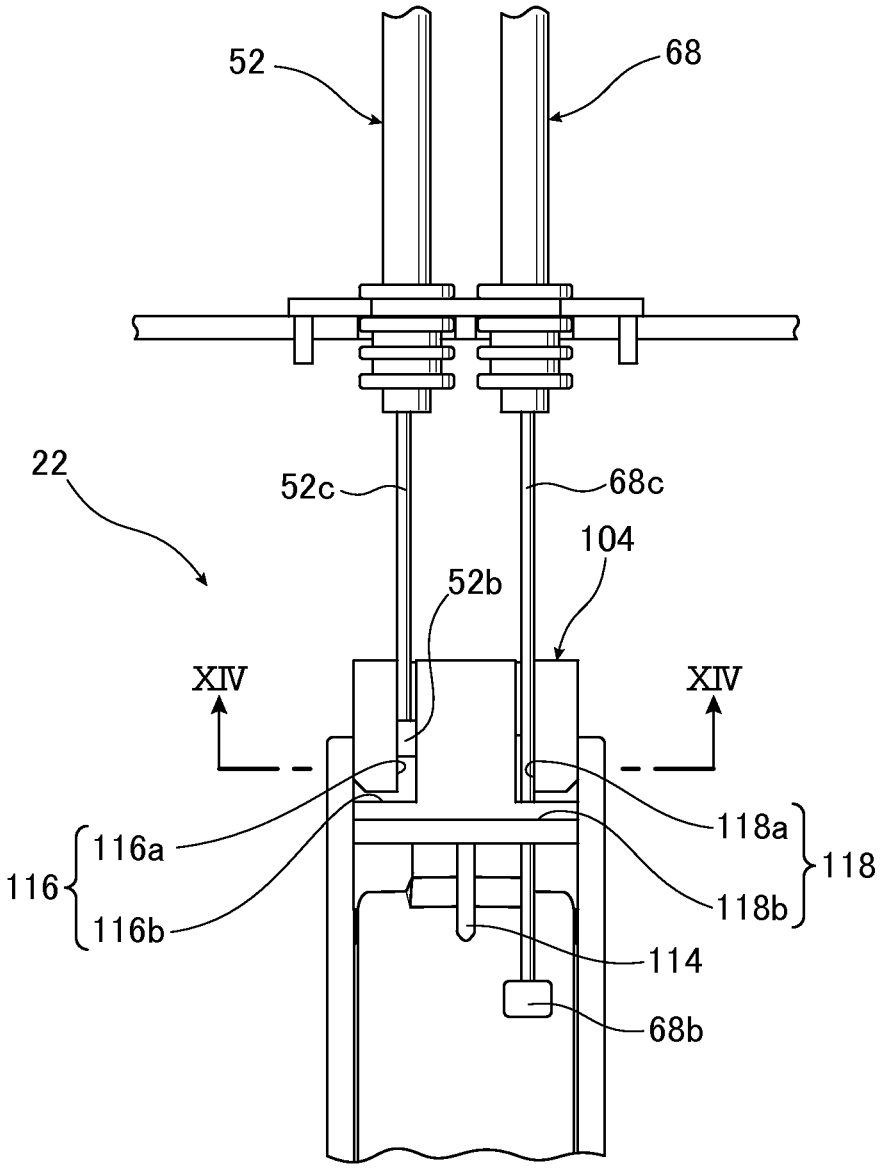
FIG. 13 is a partial expanded diagram of the same type of flush valve powered operation linking portion and manual operation linking portion as in FIG. 9, whereby the flush valve of a flush operating apparatus according to a first embodiment of the invention is opened by a manual operation using the manual operating unit.
Figure 14:
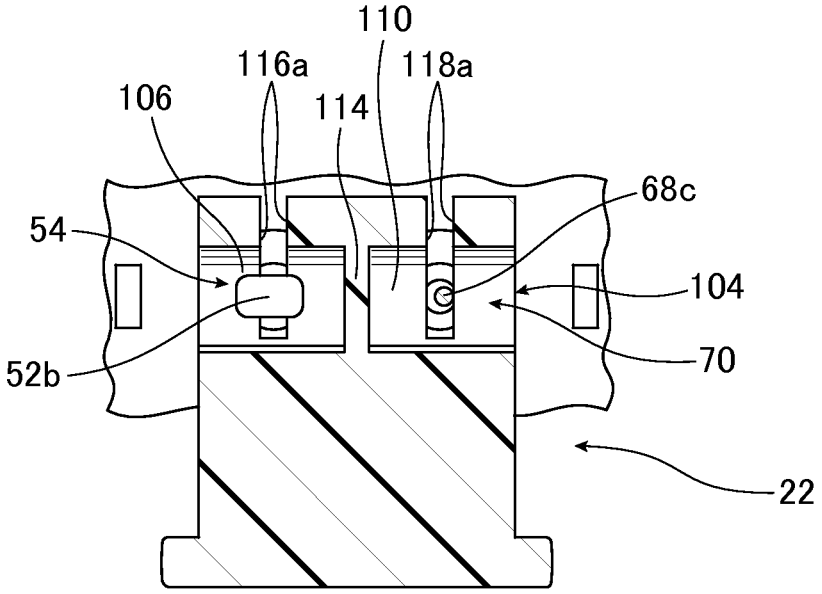
FIG. 14 is a cross section seen along line XIV-XIV in FIG. 13.

In addition, FIG. 13 is a partial expanded diagram of the same type of flush valve powered operation linking portion and manual operation linking portion as in FIG. 9, whereby the flush valve of a flush operating apparatus according to a first embodiment of the invention is opened by a manual operation using the manual operating unit. And FIG. 14 is a cross section seen along line XIV-XIV in FIG. 13.

As shown in FIG. 2 and FIGS. 5 through 8, flush valve 22 in flush operating apparatus 1 of the present embodiment includes: a valve body 94 disposed on its lower portion; a valve body holding portion 100 for sandwiching and holding this valve body 94 from above and below; a main shaft portion 102 disposed on the bottom end portion of this valve body holding portion 100 and extending so as to vertically penetrate approximately the center portion of discharge holding member 82; and a projecting portion 104, formed to project diagonally upward from the top end portion of main shaft portion 102 in the longitudinal direction of main shaft portion 102 relative to center axis line C5.

In addition, as shown in FIGS. 6 and 8, a front indentation 106 indented on the rear side is formed on the front surface 104*a* of projecting portion 104. As a result, projecting portion 104 on the top side of front indentation 106 forms an upward-projecting front hook portion 108. The top end portion of the front indentation 106 formed on the bottom side of this front hook portion 108 functions as the above-described manual operation linking portion 54.

Similarly, as shown in FIGS. 7 and 8, a rear indentation 110 indented on the front side is formed in rear surface 104*b* of projecting portion 104. As a result, projecting portion 104 on the top side of rear indentation 110 forms a downward-projecting rear hook portion 112. The top end portion of the rear indentation 110 formed on the bottom side of this rear hook portion 112 functions as the above-described powered operation linking portion 70.

Next, as shown in FIGS. 6 through 10, flush valve 22 manual operation linking portion 54 and powered operation linking portion 70 are disposed in mutual parallel in the front to back direction on projecting portion 104 of flush valve 22.

Also, a partition wall 114 for partitioning between manual operation wire member 52*c* and powered operation wire member 68*c* in the front to back direction is formed between manual operation linking portion 54 and powered operation linking portion 70 of flush valve 22; this partition wall 114 functions as an interference prevention portion that prevents interference upon mutual contact of manual operation wire member 52*c* and other end portion thereof 52*b* with powered operation wire member 68*c* and other end portion thereof 68*b*.

Furthermore, as shown in FIGS. 9 and 10, a slot 116 for manual operation wire member attachment and a slot 118 for powered operation wire member attachment, into which manual operation wire member 52*c* and powered operation wire member 68*c* are respectively removably inserted and attached, are respectively formed on manual operation linking portion 54 and powered operation linking portion 70 of flush valve 22. Each of the slots 116 and 118 is independently partitioned by partition wall 114, respectively communicating with front indentation 106 and rear indentation 110, functioning as an interference prevention portion that prevents interference upon mutual contact of manual operation wire member 52*c* other end portion 52*b* and powered operation wire member 68*c* other end portion 68*b*.

The slot width of each of the slots 116 and 118 is formed to have a slightly larger dimension than the diameter of manual operation wire member 52*c* and powered operation wire member 68*c*, but is formed to a dimension smaller than that of manual operation wire member 52*c* other end portion 52*b* and powered operation wire member 68*c* other end portion 68*b*.

Furthermore, as shown in FIG. 5, in a state whereby flush valve 22 is closing off discharge port 20, manual operation wire member 52*c* other end portion 52*b* and powered operation wire member 68*c* other end portion 68*b* respectively contact the manual operation linking portion 54 (the top end portion of front indentation 106 of projecting portion 104) and powered operation linking portion 70 (the top end portion of projecting portion 104 rear indentation 110).

As shown in FIGS. 6 through 10, in a state whereby flush valve 22 has been pulled up and opened by a powered operation by powered operating unit 26 of flush operating apparatus 1, manual operation wire member 52*c* is not pulled up, and only powered operation wire member 68*c* is pulled up; the other end portion 68*b* of this powered operation wire member 68*c* forms a projection and contacts powered operation linking portion 70 of flush valve 22 (the top end portion of projecting portion 104 rear indentation 110), and is latched to slot 118.

I.e., when flush valve 22 is opened by a powered operation using powered operating unit 26 of flush operating apparatus 1, powered operation wire member 68*c* other end portion 68*b* and flush valve 22 powered operation linking portion 70 are linked, and the link between manual operation wire member 52*c* other end portion 52*b* and flush valve 22 manual operation linking portion 54 is released.

On the other hand, as shown in FIGS. 11 through 14, in a state whereby flush valve 22 is pulled up and opened by a manual operation by flush operating apparatus 1 manual operating unit 24, powered operation wire member 68*c* is not pulled up, only manual operation wire member 52*c* is pulled up, and this manual operation wire member 52*c* other end portion 52*b* forms a projection and contacts flush valve 22 manual operation linking portion 54 (the top end portion of projecting portion 104 front indentation 106) and is latched to slot 116.

In other words, when flush valve 22 is opened by a manual operation using manual operating unit 24 of flush operating apparatus 1, manual operation wire member 52*c* other end portion 52*b* links with flush valve 22 manual operation linking portion 54, and the link between powered operation wire member 68*c* other end portion 68*b* and flush valve 22 powered operation linking portion 70 is released.

As shown in FIGS. 9 and 13, slot 116 for attaching a manual operation wire member and slot 118 for attaching a powered operation wire member are formed in an approximately L-shaped hook shape, roughly symmetrical in the left-right direction when flush valve 22 is viewed from the right side.

I.e., as shown in FIGS. 9 through 14, each of the slots 116 and 118 includes vertical slot portions 116*a*, 118*a* formed to extend downward from each top end and, from the bottom ends of each of the vertical slot portions 116*a*, 118*a*, with respect to slot 116 for manual operation wire attachment includes a horizontal slot portion 116*b* formed to extend in the horizontal direction forward, and with respect to slot 118 for powered operation wire member attachment, includes a horizontal slot portion 118*b* formed to extend in the horizontal direction rearward.

Moreover, as shown in FIGS. 10 and 14, each of the vertical slot portions 116*a*, 118*a* is open so that each of the wire members 52*c* and 68*c* can be inserted and removed from outside; as shown in FIGS. 9, 11, 12, and 13, horizontal slot portion 116*b* is a slot on which the outer and front sides are open so that manual operation wire member 52*c* can be inserted and removed from the outside and from the front. Also, horizontal slot portion 118*b* is a slot which is open on the outside and rear side so that powered operation wire member 68*c* can be inserted and removed from the outside and the rear side.

Using these vertical slot portions 116*a*, 118*a* and horizontal slot portions 116*b*, 118*b*, when manual operating unit 24 alone is used and powered operating unit 26 is removed in accordance with flush water tank apparatus 14 or toilet main unit 4 usage conditions, such as the flush method specifications pertaining to flush water tank apparatus 14 or toilet main unit 4, or the installation environment such as supply water pressure at the installation location, or installation conditions including the layout in the toilet apparatus 2 installation space, etc., a setup can be adopted whereby only powered operation wire member 68*c* is removed from slot 118, and only manual operation wire member 52*c* is attached to slot 116. Similarly, when manual operating unit 24 is removed and only powered operating unit 26 is used, a setup can be adopted whereby only manual operation wire member 52*c* is removed from slot 116, and only powered operation wire member 68*c* is attached to slot 118.

In the present embodiment, while the flush valve 22 can be independently raised and opened by the respective manual operation using manual operating unit 24 and powered operation using powered operating unit 26 of flush operating apparatus 1, the amount of flush water discharged from the discharge port 20 on storage tank 16 in flush water tank apparatus 14 by discharge apparatus 34 and supplied into the toilet main unit 4 conduit (not shown) increases as the amount of lifting of flush valve 22 is increased and the height by which valve body 94 rises relative to toilet seat 92 (the stroke) is raised, so that toilet flushing is carried out by a large flush.

Next, referring to FIGS. 1 through 14, we explain the operation (action) of a flush operating apparatus according to a first embodiment of the invention.

First, when opening flush valve 22 by a powered operation using flush operating apparatus 1 powered operating unit 26 starting from a state in which flush valve 22 is holding discharge port 20 closed (a standby state), if a user either instructs a toilet flushing operation by pushing a predetermined operating button 28*a* on instruction device 28, or human sensor 30 senses a user, these signals are transmitted to control device 12 and powered operating unit 26 power drive motor 58 is activated by a command from control device 12.

Power rotary drive shaft 60 then rotates about rotation center axis line C3 a predetermined number of revolutions or to a predetermined rotary angle in the direction of rotation shown by arrow B in FIG. 4, and power receiving gear 64 and pulley 60 rotate about rotation center axis line C4. As a result, powered operation linking member 68 moves together with the rotation of pulley 66 as it is being spooled onto the outer circumference portion 66*b* of pulley 66; after being raised a predetermined length, power drive motor 58 stops for a predetermined time, and flush valve 22 rises up to a predetermined height and is in an open state for a predetermined time. Flush water inside storage tank 16 is thus discharged from discharge port 20 toward the toilet main unit 4 conduit (not shown).

At this time, from the flush valve 22 closed valve state until it rises by a powered operation of powered operating unit 26 to an open valve state, as shown in FIGS. 6 through 10, powered operation wire member 68*c* other end portion 68*b* is linked with flush valve 22 powered operation linking portion 70, and the link between manual operation wire member 52*c* other end portion 52*b* and flush valve 22 manual operation linking portion 54 is released.

After flush valve 22 has been open for a predetermined time, once power drive motor 58 power rotary drive shaft 60 has rotated about rotation center axis line C3 a predetermined number of rotations or is at a predetermined rotation angle in a direction opposite the direction of rotation shown by arrow B in FIG. 4, power drive motor 58 again stops and flush valve 22 drops and closes discharge port 20, returning to the original standby state.

On the other hand, when releasing flush valve 22 by a manual operation using manual operating unit 24 in flush operating apparatus 1 starting from a state in which flush valve 22 closes off discharge port 20 (the standby state), as shown by arrow A for the manual operation direction in FIG. 3, the user, by rotating manual operating lever 44 about rotation center axis line C1 so as to pull it downward, causes manual rotary shaft 42 and manual drive gear 46 to rotate about rotation center axis line C1, so that manual drive receiving gear 48 and pulley 50 rotate about rotation center axis line C2. Thus the manual operation linking member 52 manual operation wire member 52*c* moves as it is spooled onto pulley 50 outer circumference 50*b* together with the rotation of pulley 50 and is pulled up by a predetermined length, so that flush valve 22 is placed in a closed state.

At this time, from the 22 closed valve state until it rises by a manual operation of flush operating apparatus 1 manual operating unit 24 to an open valve state, as shown in FIGS. 11 through 14, manual operation wire member 52*c* other end portion 52*b* is linked to flush valve 22 manual operation linking portion 54, and the link between powered operation wire member 68*c* other end portion 68*b* and flush valve 22 powered operation linking portion 70 is released.

When a user releases his hand from manual operating lever 44 with manual operation linking member 52 lifted up and flush valve 22 in an open valve state, manual operating lever 44 is rotated so as to return to the original standby state position by a return spring (not shown); flush valve 22 drops and discharge port 20 is closed, returning the toilet to the standby state.

Using the flush operating apparatus 1 according to a first embodiment of the above-described invention, powered operating unit 26, which can operate by power the motion of flush valve 22 for opening and closing the flush water tank apparatus 14 storage tank 16 discharge port 20, is provided separately from manual operating unit 24, and is removably placed relative to toilet main unit 4, in accordance with flush water tank apparatus 14 or toilet main unit 4 usage conditions, such as specifications including the flush method for flush water tank apparatus 14 or toilet main unit 4, or installation environment such as water supply pressure at the location of installation, or installation conditions including the placement environment, such as the layout within the toilet apparatus 2 installation space, etc., therefore when performing a toilet flushing operation with powered operation unit 26 attached, operation of flush valve 22 can be controlled by a user's manual operation of manual operating unit 24, and operation of flush valve 22 can be controlled by the powered operation of powered operating unit 26, so that an appropriate selection can be made as needed of the method for operating flush valve 22.

When a user controls the operation of flush valve 22 by a powered operation using powered operating unit 26, a start toilet flush signal transmitted from an instruction device 28 to which a user instructs a toilet flushing operation, or from a body sensor 30 for sensing a user, is received by control device 12, and powered operating unit 26 power drive motor 58 is automatically activated. Therefore the rotary power of power drive motor 58 power rotary drive shaft 60 is transferred from powered drive gear 62 through power receiving gear 64, pulley 66, and powered operation wire member 68*c* as actuating force to flush valve 22 powered operation linking portion 70, so that the up and down movement operation of flush valve 22 can be automated. As a result, when compared to toilet flushing using only manual operating unit 24, flush valve 22 can be operated efficiently, and ease of use improved.

On the other hand, when powered operating unit 26 is unnecessary, the structure of flush water tank apparatus 14 or toilet main unit 4 can be simplified by removing only powered operating unit 26, and a change can be easily effected to a specification allowing for toilet flushing operation by manual operating unit 24 on its own, thus improving ease of use.

Furthermore, because powered operating unit 26 can be easily added later to existing flush water tank apparatuses or toilet main units not including a powered operating unit 26, but including only manual operating unit 24, the flush water tank apparatus or toilet main unit specification and flush operating method can be easily changed, thereby improving usability.

Also, using a flush operating apparatus 1 according to the invention, when operating powered operating unit 26, powered operation wire member 68*c* other end portion 68*b* is linked to flush valve 22 powered operation linking portion 70, while the link between manual operation wire member 52*c* other end portion 52*b* and flush valve 22 manual operation linking portion 54 is released; when operating manual operating unit 24, manual operation wire member 52*c* other end portion 52*b* is linked to flush valve 22 manual operation linking portion 54, while the link between powered operation wire member 68*c* other end portion 68*b* and flush valve 22 powered operation linking portion 70 is released, therefore a state can be prevented whereby powered operation wire member 68*c* other end portion 68*b* and manual operation wire member 52*c* other end portion 52*b* are simultaneously respectively linked to flush valve 22 powered operation linking portion 70 and manual operation linking portion 54 during a powered operation by powered operating unit 26 or a manual operation by manual operating unit 24. When operating flush valve 22 by power or manually using powered operating unit 26 or manual operating unit 24, mutual interference between powered operation wire member 68*c* and manual operation wire member 52*c* can be prevented, and the simultaneous transfer of excessive operating force to flush valve 22 from both powered operation wire member 68*c* and manual operation wire member 52*c* can be prevented. Therefore since either powered operation wire member 68*c* or manual operation wire member 52*c* can operate flush valve 22 by itself, usability can be improved.

In addition, using the flush operating apparatus 1 according to the present invention, flush valve 22 includes: valve body 94, which opens and closes by the up and down movement of discharge port 20 formed on the bottom portion 16*a* of storage tank 16 in flush water tank apparatus 14; valve body holding portion 100 for sandwiching and holding this valve body 94 from above and below; main shaft portion 102 disposed on the bottom end portion of this valve body holding portion 100 and extending so as to vertically penetrate approximately the center portion of discharge holding member 82; and projecting portion 104, formed to project diagonally upward from the top end portion of main shaft portion 102 in the longitudinal direction of main shaft portion 102 relative to center axis line C5; powered operation linking portion 70 and manual operation linking portion 54 are respectively disposed in parallel in the front to back direction on this projecting portion 104. Because a partitioning wall 114 is formed for partitioning in the front to back direction between manual operation wire member 52*c* and powered operation wire member 68*c*, and this partition wall 114 functions as an interference prevention portion that prevents interference between manual operation wire member 52*c* and its other end portion 52*b*, and between powered operation wire member 68*c* and its other end portion 68*b*, therefore when selecting either powered operating unit 26 or manual operating unit 24 and operating flush valve 22 either by power or manually, mutual interference can be prevented using a simple structure relative to powered operation wire member 68*c* and manual operation wire member 52*c*, and flush valve 22 powered operation linking portion 70 and manual operation linking portion 54 can be respectively efficiently linked.

In addition, using flush operating apparatus 1 according to the present invention, a projection is formed so that when powered operating unit 26 is operated, powered operation wire member 68*c* other end portion 68*b* is latched and linked to powered operation linking portion 70 slot 118 on flush valve 22, so that the link between manual operation wire member 52*c* other end portion 52*b* and manual operation linking portion 54 slot 116 on flush valve 22 is released. On the other hand, when manual operating unit 24 is operated, a projection is formed so that manual operation wire member 52*c* other end portion 52*b* is latched and linked to the manual operation linking portion 54 slot 116 on flush valve 22, so the link between powered operation wire member 68*c* other end portion 68*b* and powered operation linking portion 70 slot 118 on flush valve 22 is released. Therefore during powered operation using powered operating unit 26 or manual operation using manual operating unit 24*c*, a state whereby powered operation wire member 68*c* other end portion 68*b* and manual operation wire member 52*c* other end portion 52*b* are simultaneously respectively latched and linked to the powered operation linking portion 70 slot 118 and manual operation linking portion 54 slot 116 of flush valve 22 can be prevented.

Also, when operating flush valve 22 with power or manually using powered operating unit 26 or manual operating unit 24, because powered operation wire member 68*c* and manual operation wire member 52*c* are respectively independently inserted into powered operation linking portion 70 slot 118 and manual operation linking portion 54 slot 116 of flush valve 22 serving as interference prevention portion, mutual interference between powered operation wire member 68*c* and manual operation wire member 52*c* can be effectively prevented.

Furthermore, simultaneous transfer of excessive operating force to the powered operation linking portion 70 manual operation linking portion 54 of flush valve 22 from powered operation wire member 68*c* other end portion 68*b* and manual operation wire member 52*c* other end portion 52*b*, respectively, can also be prevented. Since either powered operation wire member 68*c* or manual operation wire member 52*c* can operate flush valve 22 by itself, usability can be improved. Also, when powered operating unit 26 is not needed, powered operation wire member 68*c* can be easily detached from the powered operation linking portion 70 slot 118 of flush valve 22 when only the powered operating unit 26 is removed, therefore the specification can easily be changed to allow a toilet flush operation with manual operating unit 24 alone, and usability can be improved.

Also, using flush operating apparatus 1 according to the present embodiment, powered operating unit 26 powered drive gear 62 and power receiving gear 64 are designed so that the reference circle diameter D1 of powered drive gear 62 has a smaller dimension than the reference circle diameter D2 of manual drive gear 46 (D1<D2), so that the maximum torque T1 of power drive motor 58 power rotary drive shaft 60 can be designed to be smaller than the maximum torque T2 of manual operating unit 24 manual rotary shaft 42, therefore the drive force (maximum torque T1) of power drive motor 58 power rotary drive shaft 60 can be set at a low level, and the entire casing 72 of powered operating unit 26 can be made compact.

Moreover, using flush operating apparatus 1 according to the present embodiment, power receiving gear 64 reference circle diameter D3 is designed to have a larger dimension than powered drive gear 62 reference circle diameter D1, and power receiving gear 64 maximum torque T3 is designed to be larger than powered drive gear 62 maximum torque T1, therefore even if power drive motor 58 power rotary drive shaft 60 maximum torque T1 is designed to be small, power receiving gear 64 and pulley 66 can turn at a larger torque than power rotary drive shaft 60 and powered drive gear 62. Therefore powered operation wire member 68*c* can be efficiently moved along the outer circumference portion 66*b* of pulley 66, and the entire powered operating unit 26 casing 72 can be made compact.

Also, using flush operating apparatus 1 according to the present embodiment, when performing a toilet flushing operation with powered operating unit 26 attached, operation of flush valve 22 can be controlled by a user's manual operation of manual operating unit 24, and operation of flush valve 22 can be controlled by the powered operation of powered operating unit 26, so that an appropriate selection can be made as needed of the method for operating flush valve 22. When a user controls the operation of flush valve 22 with power using powered operating unit 26, flush valve 22 can be more efficiently actuated compared to when the toilet flushing operation is performed using manual operating unit 24 only, and a toilet apparatus 2 with improved usability can be provided.

On the other hand, when powered operating unit 26 is unnecessary in accordance with flush water tank apparatus 14 or toilet main unit 4 usage conditions, such as specifications including the flush method for flush water tank apparatus 14 or toilet main unit 4, or installation environment such as water supply pressure at the location of installation, or installation conditions including the placement environment, such as the layout within the toilet apparatus 2 installation space, the structure of flush water tank apparatus 14 or toilet main unit 4 can be simplified by removing only powered operating unit 26, and a change can be easily effected to a specification allowing for toilet flushing operation by flush operating apparatus 1 manual operating unit 24 on its own, thus improving ease of use.

Furthermore, because powered operating unit 26 can be easily added later to existing flush water tank apparatuses not including a powered operating unit 26 but including only manual operating unit 24, flush water tank apparatus 14 or toilet main unit 4 specifications and flush operating method can be easily changed, so that a toilet apparatus 2 with improved usability can be provided.

In addition, using flush operating apparatus 1 according to the present embodiment, the powered operating unit 26 casing 72 containing powered drive gear 62, power receiving gear 64, pulley 66, and one end portion 68*a* of powered operation linking member 68, plus power drive motor 58, are attached to the housing portion 74 (see FIG. 1) disposed on one of the side surfaces 16*c* of storage tank 16 so as to be appropriately removable depending on the usage conditions of flush water tank apparatus 14, toilet main unit 4, etc. In addition to this, a notched channel 78 is formed at approximately the left-right center of the top end portion of rear wall portion 16*b* forming flush water tank apparatus 14 storage tank 16, so as to penetrate in the front to back direction with an approximately U-shaped cross section; this notched channel 78 is positioned above water stop level WL1 inside storage tank 16, and powered operating unit 26 powered operation linking member 68 is insertable between the interior and exterior of storage tank 16, so the flush operating apparatus 1 powered operating unit 26 can be easily attached and removed relative to toilet apparatus 2.

Therefore flush water tank apparatus 14 or toilet main unit 4 specifications and flush operating method can be easily changed in accordance with flush water tank apparatus 14 or toilet main unit 4 usage conditions, and a toilet apparatus 2 with improved usability can be provided. Also, in a state whereby the powered operating unit 26 casing 72 and power drive motor 58 of flush operating apparatus 1 are attached to housing portion 74 on storage tank 16 side surface 16*c*, powered drive gear 62, power receiving gear 64, pulley 66, and powered operation linking member 68 one end portion 68*a*, as well as power drive motor 58, are disposed on the outside of flush water tank apparatus 14 storage tank 16, so no flush water on the interior of storage tank 16 impinges thereon, and malfunctions can be prevented.

In addition, using flush operating apparatus 1 according to the present embodiment, the powered operating unit 26 casing 72 containing powered drive gear 62, power receiving gear 64, pulley 66, and one end portion 68*a* of powered operation linking member 68, plus power drive motor 58, are attached to the housing portion 74 (see FIG. 1) disposed on the side surface 16*c* of storage tank 16, and by the attachment of a cover member 76 so as to cover these elements from the outside, dust does not adhere to flush operating apparatus 1 powered operating unit 26 casing 72 or power drive motor 58, and malfunctions can be prevented.

Below, referring to FIG. 15, we explain a flush operating apparatus according to a second embodiment of the invention.

Figure 15:
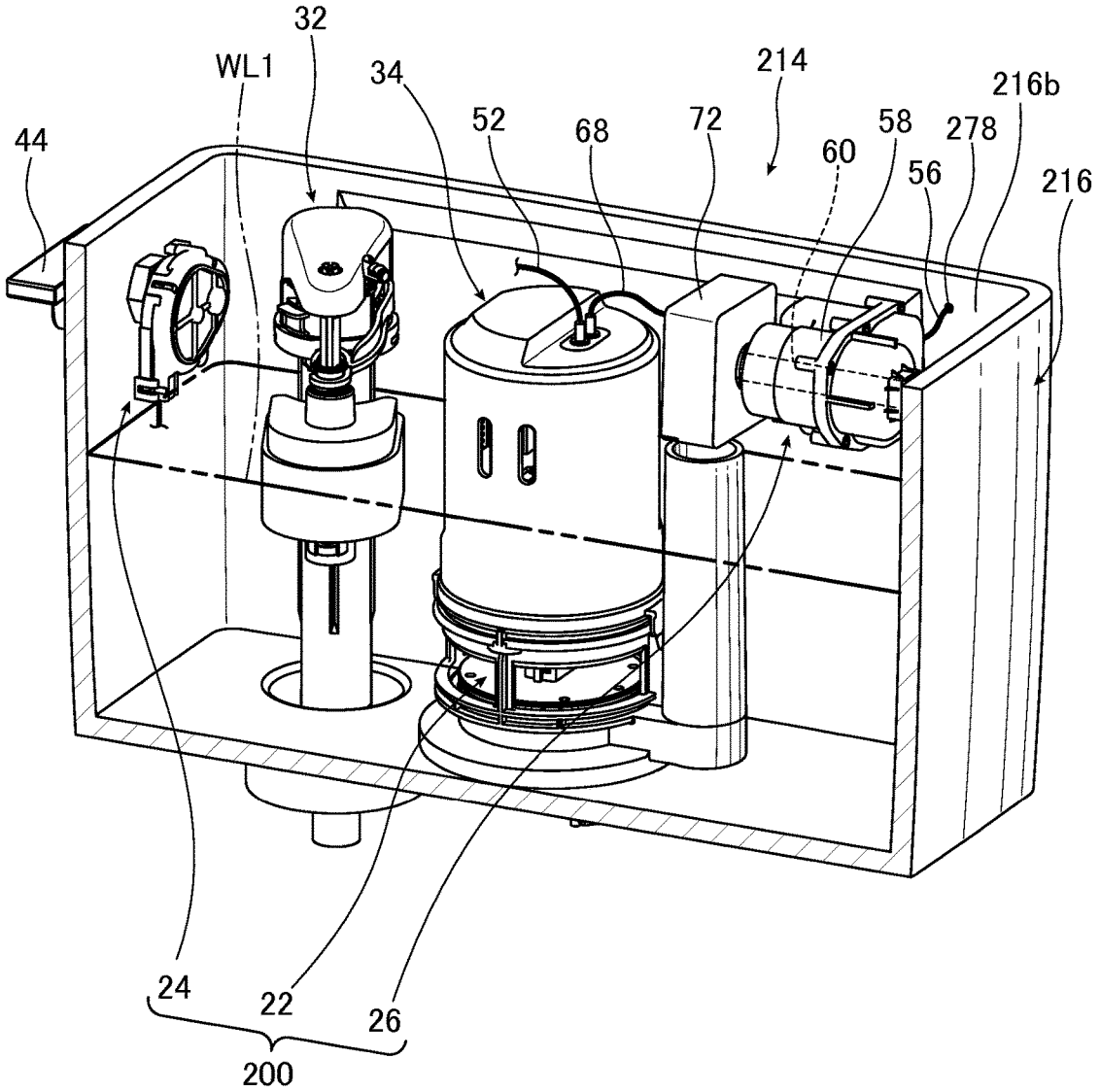
FIG. 15 is a perspective view seen from diagonally front of and above the interior structure of a flush water tank apparatus to which a flush operating apparatus according to a second embodiment of the invention is applied.

FIG. 15 is a perspective view seen from diagonally front of and above the interior structure of a flush water tank apparatus to which a flush operating apparatus according to a second embodiment of the invention is applied.

Note that for the flush operating apparatus according to the second embodiment of the present invention shown in FIG. 15, and the toilet apparatus and flush water tank apparatus to which this flush operating apparatus is applied, the same reference numerals are assigned for the same parts of the flush operating apparatus according to a first embodiment of the present invention shown in FIG. 2, and an explanation thereof is here omitted.

As shown in FIG. 15, in the flush operating apparatus 200 according to a second embodiment of the invention, powered operating unit 26 power drive motor 58 is removably disposed on the rear wall portion 216*b* of storage tank 216 of flush water tank apparatus 214. Also, electrical wire 56, which connects control device 12 and power drive motor 58, and insertable insertion hole 278, are positioned above water stop level WL1 inside storage tank 216 on rear wall portion 216*b* of storage tank 216, and formed so as to penetrate in the front to back direction at the rear wall portion 216*b* of storage tank 216. As a result, flush operating apparatus 200 according to a second embodiment of the invention differs from flush operating apparatus 1 of the first embodiment on the point that the entire powered operating unit 26 is removably attached to the interior of storage tank 216 in accordance with flush water tank apparatus 214 or toilet main unit 4 usage conditions.

Using the above-described flush operating apparatus 200 according to a second embodiment of the invention, powered operating unit 26 is removably attached to the interior of storage tank 216 in accordance with flush water tank apparatus 214 or toilet main unit 4 usage conditions, therefore the peripheral space outside storage tank 216 can be simplified, and a toilet apparatus 204 with improved usability can be provided.

Note that as a third embodiment different from flush operating apparatus 1 according to the first embodiment and flush operating apparatus 200 according to the second embodiment of the invention, it is also acceptable, with respect to the powered operating unit 26 casing 72 containing powered drive gear 62, power receiving gear 64, pulley 66, and one end portion 68*a* of powered operation linking member 68, plus power drive motor 58, to removably attach these to a portion of the outside surface of the flush operating apparatus storage tank, and to form, at a position above flush water stop level WL1 in the storage tank, a hole or slot between the interior and exterior of the storage tank into which powered operating unit 26 powered operation linking member 68 can be inserted.

Using such a flush operating apparatus according to a third embodiment of the invention, the flush water tank and toilet main unit specifications and flush operation method can be easily changed, and a toilet apparatus with improved usability can be provided. In a configuration in which the powered operating unit 26 casing 72 of the flush operating apparatus and the power drive motor 58 are attached to the outside of the storage tank, no flush water inside the storage tank impinges on casing 72 or power drive motor 58, and malfunctions can be avoided.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush operating apparatus for discharging flush water from a flush water tank into a toilet, the flush operating apparatus comprising:

a flush valve for opening and closing a discharge port on the flush water tank storing flush water to flush the toilet;

a manual operating unit, being provided on the flush water tank and capable of manually operating a motion of the flush valve, the manual operating unit having a manual rotary shaft, a manual operating portion for manual rotary operation of the manual rotary shaft, a manual rotary force transfer portion that transfers a rotary force of the manual rotary shaft, and a manual operation linking member including first and second ends, the first end of the manual operation linking member being linked with the manual rotary force transfer portion, and the second end of the manual operation linking member being linked with the flush valve;

a powered operating unit, being capable of operating the motion of the flush valve with power, the powered operating unit having a powered drive portion including a rotary drive shaft for rotationally driving by using electrical power; a powered drive transfer portion linked to the rotary drive shaft of the powered drive portion, the powered drive transfer portion being configured to transfer a rotational drive force of the powered drive portion; and a powered operation linking member including first and second ends, the first end of the powered operation linking member being linked with the powered drive transfer portion and the second end of the powered operation linking member being linked with the flush valve; and a control portion which receives a toilet flush start signal transmitted from either an instruction portion by which a user instructs a toilet flush operation, or from a body sensing portion that senses a user, and the control portion then activates the powered drive portion;

wherein the powered operating unit is separately installed from the manual operating unit, and is installed so as to be removable from the flush water tank;

wherein the manual rotary force transfer portion includes a manual operating rotary member to which the first end of the manual operation linking member is linked, the manual operating rotary member being in the form of a minor circular sector and being rotated by a rotation of the manual rotary shaft so that the manual operation linking member moves in a direction of a rotation of the manual operating rotary member as the manual operation linking member is spooled onto an outer circumference of the manual operating rotary member;

wherein the powered drive transfer portion includes a powered operating rotary member to which the first end of the powered operation linking member is linked, the powered operating rotary member being in the form of a minor circular sector and being rotated by a rotation of the powered rotary drive shaft so that the powered operation linking member moves in a direction of a rotation of the powered operating rotary member as the powered operation linking member is spooled onto an outer circumference of the powered operating rotary member;

wherein the flush valve includes a powered operation linking portion to which the second end of the powered operation linking member is releasably engaged, and a manual operation linking portion to which the second end of the manual operation linking member is releasably engaged;

wherein when operating the powered operating unit, the second end of the powered operating linking member is engaged with the powered operating linking portion, and an engagement between the second end of the manual operation linking member and the manual operation linking portion of the flush valve is released; and wherein when operating the manual operating unit, the second end of the manual operating linking member and the manual operation linking portion of the flush valve are engaged, while the engagement between the second end of the powered operation linking member and the powered operation linking portion of the flush valve is released.

2. The flush operating apparatus according to claim 1, wherein a plurality interference prevention portions that prevent an interference between the powered operation linking member and the manual operation linking member are provided between the powered operation linking portion and the manual operation linking portion of the flush valve.

3. The flush operating apparatus according to claim 2, wherein the flush valve includes a valve body portion, the valve body portion being moved up and down to open and close the discharge port formed on a bottom portion of the flush water tank; the powered operation linking portion and manual operation linking portion are respectively arrayed in parallel on a top end portion extending upward from the valve body portion; one of the interference prevention portions is a partition wall formed to partition the powered operation linking portion from the manual operation linking portion.

4. The flush operating apparatus according to claim 2, wherein a first slot, into which the powered operation linking member is detachably inserted and attached, is formed as one of the interference prevention portions on the powered operation linking portion of the flush valve; a second slot, into which the manual operation linking member is insertably attached, is formed as an other of the interference prevention portions on the manual operation linking portion of the flush valve; the second end of the powered operation linking member is formed to be larger than a size of the first slot, and includes a first raised portion able to latch the first slot when operating the powered operating unit; and the second end of the manual operation linking member is formed to be larger than a size of the second slot, and includes a first raised portion able to latch the second slot when operating the manual operating unit.

5. The flush operating apparatus according to claim 1, wherein the powered drive transfer portion of the powered operating unit includes a power drive gear placed on the rotary drive shaft of the powered drive portion, and a power receiving gear for meshing and engaging the power drive gear;

wherein the manual operating unit further includes a manual drive gear affixed to the manual rotary shaft; and wherein a reference circle diameter of the power drive gear is smaller than a reference circle diameter of the manual drive gear.

6. The flush operating apparatus according to claim 5, wherein the power receiving gear is placed on the powered operating rotary member and is designed to have a larger torque than the power drive gear.

7. A toilet apparatus comprising:

the flush operating apparatus according to claim 1;

a toilet main unit including a bowl portion; and the flush water tank storing flush water to flush the bowl portion of the toilet main unit, the flush valve of the flush operating apparatus being positioned in the flush water tank.

8. The flush operating apparatus according to claim 7, wherein the power drive portion and the powered drive transfer portion of the powered operating unit are removably attached to the flush water tank, and a hole or channel into which the powered operation linking member of the powered operating unit can be inserted is formed between an interior and an exterior of the flush water tank above a flush water stop level in the flush water tank.

9. The flush operating apparatus according to claim 8, wherein the power drive portion and the powered drive transfer portion of the powered operating unit are attached to a housing portion placed on a side surface of the flush water tank, and a cover member is attached to the housing portion so as to cover the power drive portion and the powered drive transfer portion.

10. The flush operating according to claim 7, wherein the powered operating unit of the flush operating apparatus is removably attached on an interior of the flush water tank.

* * * * *